United States Patent [19]

Reardon

[11] 4,212,355

[45] Jul. 15, 1980

[54] TUBING MANIPULATED TEST VALVE AND LATCH ASSEMBLY

[75] Inventor: Daniel R. Reardon, Houston, Tex.

[73] Assignee: Lynes, Inc., Houston, Tex.

[21] Appl. No.: 940,924

[22] Filed: Sep. 11, 1978

[51] Int. Cl.[2] ..... E21B 43/12

[52] U.S. Cl. ..... 166/336; 166/320; 166/334; 251/352

[58] Field of Search ..... 166/336, 330, 332, 334; 251/351, 352

[56] References Cited

U.S. PATENT DOCUMENTS

| | | | |
|---|---|---|---|
| 2,397,199 | 3/1946 | Orr | 166/334 |
| 3,102,594 | 9/1963 | Crowe | 166/125 |
| 3,291,220 | 12/1966 | Mott | 166/208 |
| 3,306,363 | 2/1967 | McZilkey, Jr. | 166/334 |
| 3,414,059 | 12/1968 | Nutter | 166/334 |
| 3,568,715 | 3/1971 | Taylor, Jr. | 137/613 |

*Primary Examiner*—James A. Leppink
*Attorney, Agent, or Firm*—William C. Norvell, Jr.

[57] ABSTRACT

A test valve assembly is provided which is adapted to be lowered on a tubular string between upper and lower tubular sections into position within a blowout preventer stack at the upper end of a well bore of a subterranean oil or gas well. The apparatus has first and second fluid flow passageways within a housing. A valve member is disposed between the flow passageways and is shiftable to open position to communicate the flow passageways during selective incremental testing of the well and is manipulatable to closed position to isolate the flow passageways prior to and subsequent to selective incremental testing of the well. Means are provided which are responsive to mechanical manipulation of the tubular string for shifting of the valve member between closed and open positions. The apparatus and the tubular string may be selectively latched with respect to one another without manipulation of the valve member between closed and open positions. Clutch means are provided whereby the upper tubular section may be selectively rotationally engaged with the lower tubular section during testing of the well and when the valve member is in open position. Auxiliary hydraulically activated valve manipulation and unlatching means also are provided.

26 Claims, 30 Drawing Figures

304
305
300
306
303
301
311A
307A
302
100
101
307,308
309,310
115,116
318
319
C
312A
315B
312
315A
313
313A
311
320
314
107
500
321
322
315
316
A
15
B
124
317
140
129
120,121
127
117
128
102
132
136
135
134
133
D
147A
323
141
324
142
324A
133A
325
326,327
143
508
328
147
502
157
161F
157A
161A
161

329
408
169
521A
400
409
503
183
171
519
518
415A
520
517
414
418
402
419
E
403
516
515
191
193
404B
194
161C
105
9B
400A
404
405B
407
425
106
405
439
425A
426
405A
F
406A
9B
406
G
406B
429
431
432
430
161D
212
161E
211

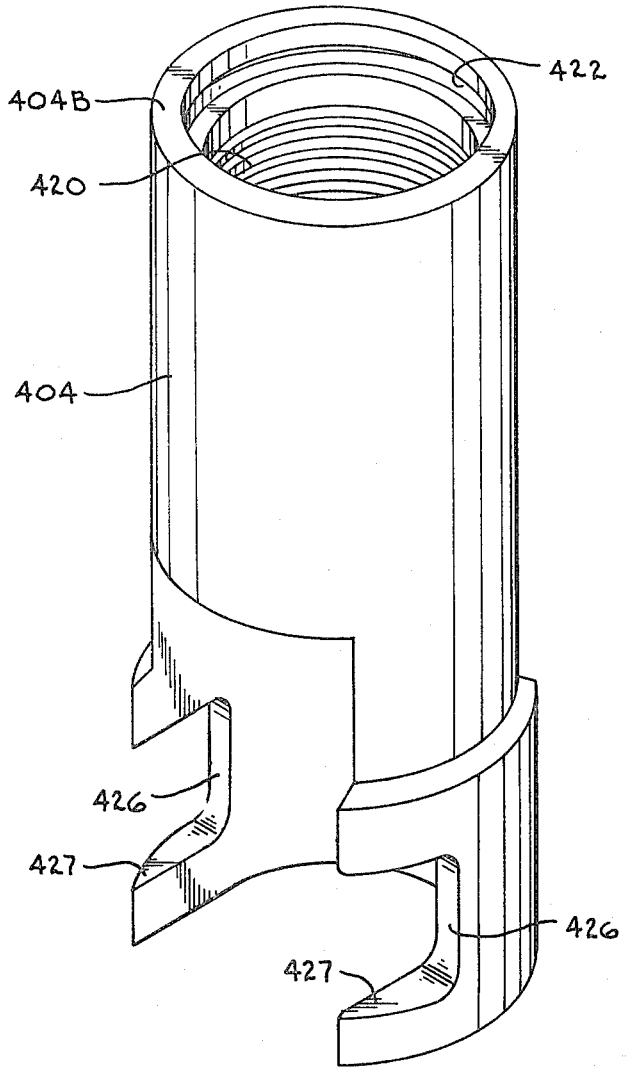
fig. 10
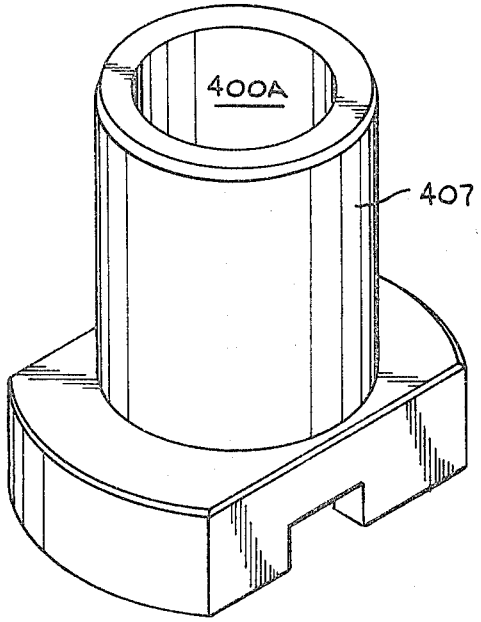

TUBING MANIPULATED TEST VALVE AND LATCH ASSEMBLY

BACKGROUND OF THE INVENTION (1) Field of the Invention

The invention relates to a test valve assembly adapted to be incorporated in a tubing or drill pipe string lowered from a drilling vessel or platform to dispose the lower portion of the string in an underwater or subsea well bore and the test valve assembly in a subsea blowout preventer stack which is suitably activated to close around the assembly.

(2) Description of the Prior Art

After the drilling of a subterranean oil or gas well at an offshore location and through a subsea well bore, it may be necessary or desirable to run on the drill string a series of drill stem or other testing equipment which may be activated or manipulated by rotation of the drill string. For example, inflatable straddle test tools are carriable on the drill string and are anchored on and sealed against the inner wall of the casing. Such equipment is inflatable to anchored and sealed relationship with the casing by rotating the drill pipe to, in turn, activate a mud pump for inflation of the packing mechanism. Since control of the well through the drill string must be maintained during the testing procedure, an apparatus having a manipulatable safety valve mechanism therein must be carried on the drill string above the test equipment for manipulation to the closed position while the well is being tested. In instances in which inflatable test tools, as described above, are utilized, the use of conventional and prior art safety valves, incorporated in a "test tree" valve assembly, such as that illustrated in U.S. Pat. No. 3,568,715, entitlted "Well Tools," Donald F. Taylor, Jr., inventor, is unsatisfactory because of the utilization of an exterior hydraulic control line which is necessary to manipulate the ball or other valving mechanism between open and closed positions, the hydraulic line extending from a control panel on the drill ship or semi-submersible, exterior of the entire length of the drill string to the "test tree," and the ball or other valve mechanism. Additionally, such hydraulically activated valve mechanisms also incorporate latching mechanisms which have been partially or completely activated by utilization of the exterior hydraulic control conduit.

When test equipment is utilized which is manipulated by tubular rotation, such prior art valve mechanisms are not acceptable for use because of considerable tubular rotation which would, in turn, require additional length of exterior control conduit. Additionally, such an exterior control conduit would become wrapped around the exterior of the tubing string, leading to possible breaks and failure of tubing integrity.

The present invention obviates the problems of prior art test tree valve mechanisms when incorporated with test equipment requiring tubular rotation for activation, by providing a test tree valving mechanism which is mechanically latched into the drill string and which manipulates the valving mechanism between opened and closed positions by tubular rotation. Additionally, the apparatus provides auxiliary hydraulic means for manipulation of the valving mechanism to the closed position from the open position, as well as unlocking of the latching mechanism, in the event of a well catastrophe or other emergency when there is insufficient time to manipulate the drill string, or when the drill string is prevented from being manipulated, the auxiliary means not requiring an exterior fluid conduit, and being operational by tubing pressure, alone.

SUMMARY OF THE INVENTION

The present invention relates to a test valve assembly which is adapted to be lowered on a tubular string between upper and lower tubular sections into position within a blowout preventer stack at the upper end of a well bore of a well. The test valve assembly defines a housing having first and second fluid flow passages therethrough. A valve member is positioned between said flow passages and is shiftable in said housing to open position for communication of said flow passages during selective incremental testing of the well. The valve member is manipulatable to the closed position to isolate the flow passages prior to and subsequent to the testing procedure. Means responsive to mechanical manipulation of the tubular string for shifting of the valve member between closed and open positions and for selective latching engagement of the valve assembly with the tubular string are provided. Clutch means are functional to selectively rotationally engage the upper and lower tubular sections during testing of the well and when the valve member is in the open position. Auxiliary hydraulically activated means are provided for manipulating the valve member between the opened and closed positions and for unlatching the apparatus from the tubular string, in the event of an emergency or in situations in which the tubular string cannot be manipulated to move the valve member between positions and unlatch the apparatus from the tubular string.

BRIEF DESCRIPTION OF THE DRAWINGS

FIGS. 5A and 5B together constitute a longitudinal sectional view of the apparatus in the test position, for insertion therethrough of drill stem test equipment, and the like.

FIG. 10 is an enlarged full exterior view of the ball yoke and ball seat retainer assembly.

DESCRIPTION OF THE PREFERRED EMBODIMENTS

The apparatus A basically comprises an outer housing 100, a stab-in assembly 300 selectively carriable therein, a valve mechanism 400 within the outer housing 100 at its lowermost end, and a hydraulic release mechanism 500 comprised of components of the stab-in assembly 300 and the outer housing 100.

Figure 2A:
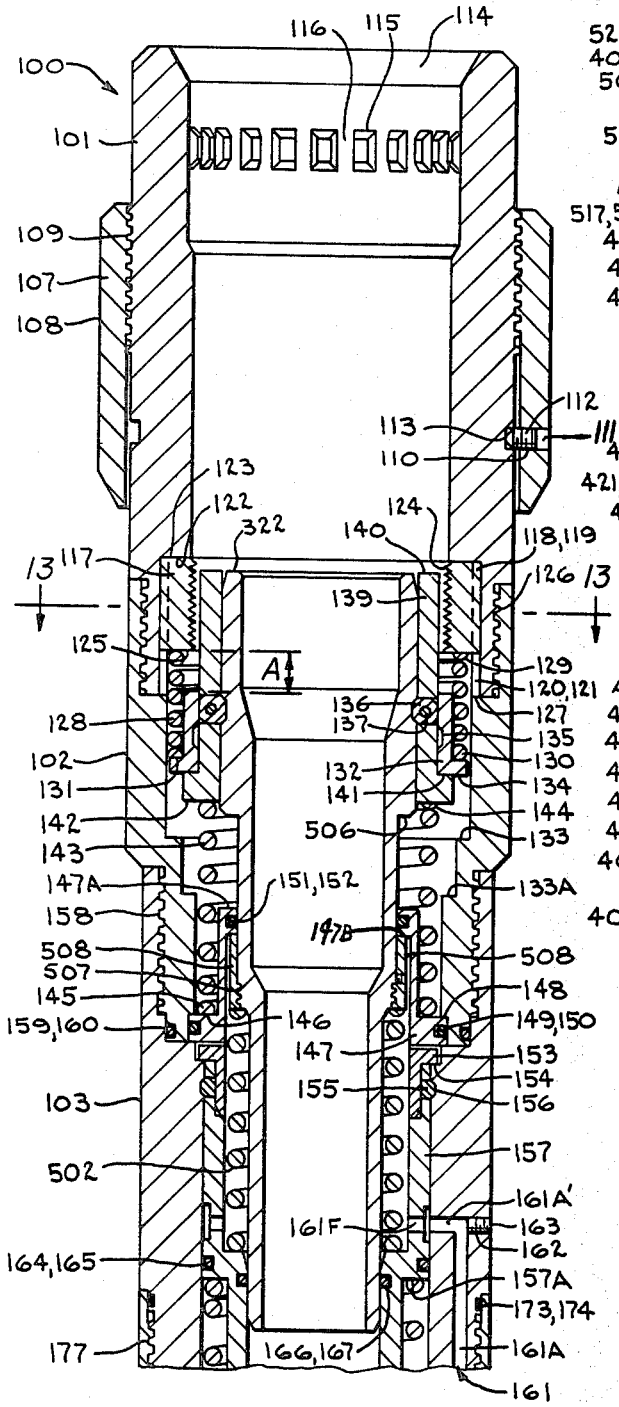
FIGS. 2A and 2B together constitute a longitudinal sectional view of the outer housing of the test tree apparatus prior to running into the well. Additionally, FIGS. 2A and 2B also illustrate the outer housing and its component parts after removal of the stab-in assembly from within the outer housing.
Figure 2B:
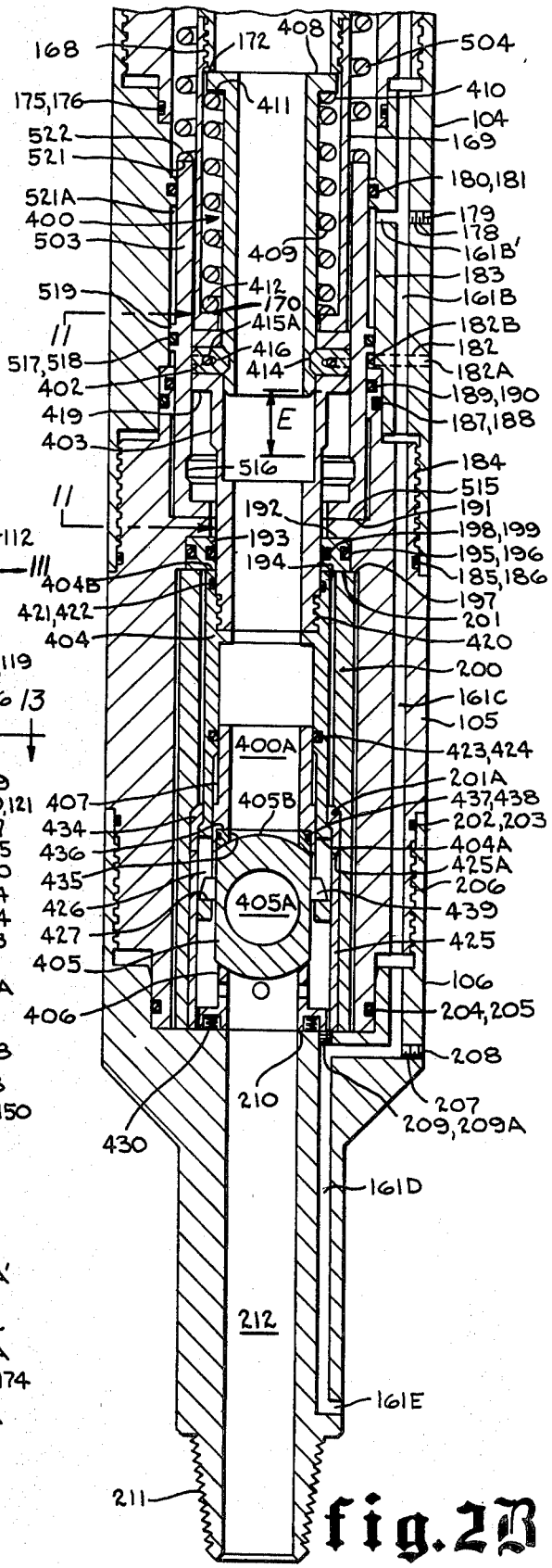

Referring now to FIGS. 2A and 2B, the outer housing 100 comprises a longitudinally extending cylindrical splined housing 101 at the uppermost end thereof, a latch housing 102 therebelow, a spring housing 103 affixed immediate the lower end of the latch housing 102, a hydraulic housing 104 immediately below the spring housing 103, a valve housing 105 defined below the hydraulic housing 104, and, finally, a bottom housing 106, which defines the terminal or lower end of the outer housing 100.

A centralizer 107, which is used to center the apparatus A within the riser R during rotation of the drill pipe DP and the apparatus A, and during the stab-in procedure, described below, is carried exterior of the upper end of the splined housing 101 and is secured thereto by threads 109, the centralizer 107 having an outer wall 108 which may come into contact with the inner diameter of the riser R during longitudinal manipulation and rotation of the outer housing 100. In effect, the centralizer 107 acts as a gauge ring and affords the outer housing 100 protection from abrasive contact with well casing, and the like. A plurality of bores 111 are within the lowermost end of the centralizer 103 for securement therethrough of companion screws 112 which are secured therein by means of threads 110, the innermost end of the screws 112 being received within a companion bore 113 in the splined housing 101, the screws 112 holding the centralizer 107 in position with respect to the splined housing 101 and being inserted within the bores 111 subsequent to the centralizer 107 being secured by means of the threads 109 to the splined housing 101.

The splined housing 101 is open at its upper end 114 to selectively permit insertion therethough of the stab-in assembly 300. A plurality of inwardly protruding splines 115 circumferentially interspaced between companion splineways 116 are defined interiorly on the splined housing 101, the splines 115 being selectively received within companion splineways 308 on the splined mandrel 301 during insertion thereof within the upper open end 114 of the splined housing 101, and companion splines 307 being selectively received within the companion splineways 116. The spline-splineway system 115-116 and 307-308 functions as a drive and clutch mechanism to co-engage the splined mandrel 301 to the splined housing 101 to rotate the outer housing 100 and the stab-in assembly 300 as a unit.

Carried within the splined housing 101 immediate the lowermost end thereof is a floating latch nut 117 which selectively receives spoons 315 of the collet 311 carired on the splined mandrel 301 of the stab-in assembly 300, to hold the collet 311 in position to selectively lock the splined mandrel 301 with the splined housing 101. The latch nut 117 contains splines 118 longitudinally extending around the circumferential exterior thereof and are interspaced between companion engrooved splineways 119 defined on the splined housing 101, such that the latch nut 117 is enabled to "float" with respect to the housing 101, as it is longitudinally manipulated within the splined housing 101. Companion splines 120 on the splined housing are interspaced and are receivable within the splineways 119. A similar longitudinal splineway 121 is interspaced on the splined housing 101 for receipt of the splines 118, the spline and splineways 118, 119, 120 and 121 providing the spline "system" for the floating latch nut 117.

The latch nut 117 has its upper face 122 which will, when the latch nut 117 is urged to its uppermost position, contact a shoulder 123 on the splined housing 101 to prevent further upward longitudinal movement of the floating latch nut 117.

Lefthand threads 124 are carried around the interior of the floating latch nut 117 for companion receipt of lefthand threads 316 carried on the spoon 315 of the stab-in assembly 300.

The floating latch nut 117 has its lower end or shoulder 125 which is interfaced with the upper end 129 of an expandable spring element 128 carried within the latch housing 102. When the upper face 122 of the floating latch nut 117 contacts the shoulder 123 on the splined housing 101 and the nut 117 is in its uppermost position, it should be noted that the distance between the lower face 125 of the nut 117 and the upper shoulder 127 on the latch housing 102 is a finite distance, for example 1¼ inches, the distance between the lower face 125 on the nut 117 and the upper shoulder 127 on the latch housing 102, when the nut 117 is in its uppermost position against the shoulder 123, being the total distance of lower travel of the nut 117.

The splined housing 101 is affixed to the latch housing 102 by means of threads 126. The latch housing 102 has, again, an upper shoulder 127 which defines the down stop for lower longitudinal travel of the floating latch nut 117, the housing 102 carrying therein the spring 128 for urging the floating latch nut 117 upwardly, the upper end 129 of the spring 128 contacting the lower end 125 of the nut 117.

The spring 128 has its lower end 130 resting upon an outwardly extending shoulder 131 of a lug retainer 132, also carried within the latch housing 102 between the spring 128 and a lug sleeve 139, the lug retainer 132 initially holding lug elements 136 initially housed partially therein within a groove 501C (see FIG. 4A) therefor, such that the lug retainer 132 and the lug sleeve 139 may be shifted longitudinally as a unit.

The lug retainer 132 has a lower face 134 which contacts a companion inwardly extending shoulder 133 upwardly facing upon the latch housing 102 to act as the down stop for the downward travel of the lug retainer 132, the lower end 130 of the spring 128 urging the lug retainer 132 against the shoulder 133. A similar shoulder 133A acts as the down stop for lower travel of the sleeve 139. A groove 135 is defined interior within the lug retainer 132 for selective receipt of the lugs 136 carried within the lug sleeve 139, the lugs 136 being secured within the sleeve 139 by means of a pin 137, the exterior of each of the pins 137 being received within a companion groove 138 (the same as groove 416 in FIG. 11) within the lug sleeve 139.

Each of the lugs 136 are normally contained and carried within a circumferentially extending groove 501C on a latch sleeve 501, but the lugs 136 may be transversely shifted out of the groove 501C and interiorly into a companion groove 135 carried around the lug retainer 132 such that the lug sleeve 139 and the lug retainer 132 thereafter are carried as a unit and the latch sleeve 501 no longer will be engaged to the lug sleeve 139 by means of the lugs 136.

The lugs 136 permit co-engagement of the lug sleeve 139 with the lug retainer 132 to move the lug sleeve 139 with the floating latch nut 117 when the stab-in assembly 300 is inserted within the outer housing 100. Additionally, the lugs 136 are permitted to carry the latch sleeve 501 when the lugs 136 are initially received within the groove 501C of the sleeve 501 to permit the collet 311 to travel downwardly and latch into the floating latch nut 117.

The lug sleeve 139 has its upper end 140 which will be contacted by the lower end 317 of the collet 311 as the stab-in assembly 300 is inserted within the outer housing 100 such that, the lugs 136 being within the groove 501C of the sleeve 501, the latch sleeve 501 and the lug retainer 132 are urged downwardly to permit the threads 316 of the collet 311 to slidingly engage along the threads 124 of the floating latch nut 117. The lug sleeve 139 also contains an outwardly extending upwardly facing shoulder 141 for interface with the lower face 134 of the lug retainer 132, the shoulder 141 being urged against the lower face 134 by the compressive force defined within a spring 143 acting upon the lower end 142 of the lug sleeve 139, such that the lug retainer 132 is urged away from the shoulder 133 on the latch housing 102.

The lower end 142 of the lug sleeve 139 receives and faces the upper end 144 of a compressive spring element 143 circumferentially carried partially around the uppermost portion of a latch sleeve stop 147, the lower end 145 of the spring 143 being received upon an upwardly facing shoulder 146 of the latch sleeve stop 147, the compressive force defined within the spring 143 being greater than that defined through the spring 128, such that the spring 143 normally urges the lug sleeve 139 and the co-engaged latch sleeve 501 upwardly and away from their respective shouldered engagement upon the latch housing 102.

A latch sleeve stop 147 is shouldered at 148 on the lowermost end of the latch housing 102 for engagement of the lower end 145 of the spring 143, and also to define the down stop for the travel of the latch sleeve 501 as it is shifted longitudinally and downwardly within the outer housing 100, when the stab-in assembly 300 is inserted within the outer housing 100. A downwardly facing interior shoulder 147B on the latch sleeve stop 147 defines the up stop against upper longitudinal travel of the latch sleeve 501 of the hydraulic release mechanism 500 when the shoulder 147B is interfaced with the upper end 513 of the latch sleeve nut 508. A circumferentially extending elastomeric O-ring seal element 149 is carried within its companion grooveway 150 around the exterior of the latch sleeve stop 147 to prevent fluid communication between the latch sleeve stop 147 and the latch housing 102. A similar O-ring seal 151 is contained within its companion grooveway 152 at the upper end of the latch sleeve stop 147 to prevent fluid communication between the latch sleeve stop 147 and the latch sleeve 501 carried interior thereof.

A lug retainer sleeve 153 is shouldered upon an upwardly facing groove 154 on the spring housing 103 to urge a retainer lock segment 155 circumferentially extending around the exterior of the sleeve 153, into its companion lock groove 156 within the spring housing 103, a spring mandrel 157 being slottedly carried by the retainer lock 155 and held in position by the interface of the retainer lock 155 in the groove 156.

The retainer lock 155 is provided so that it is impossible to hydraulically shift the valve mechanism 400 to rotate the ball 405 to the fully open position when the stab-in assembly 300 is hydraulically unlatched from the outer housing 100, as also described below.

Figure 6A:
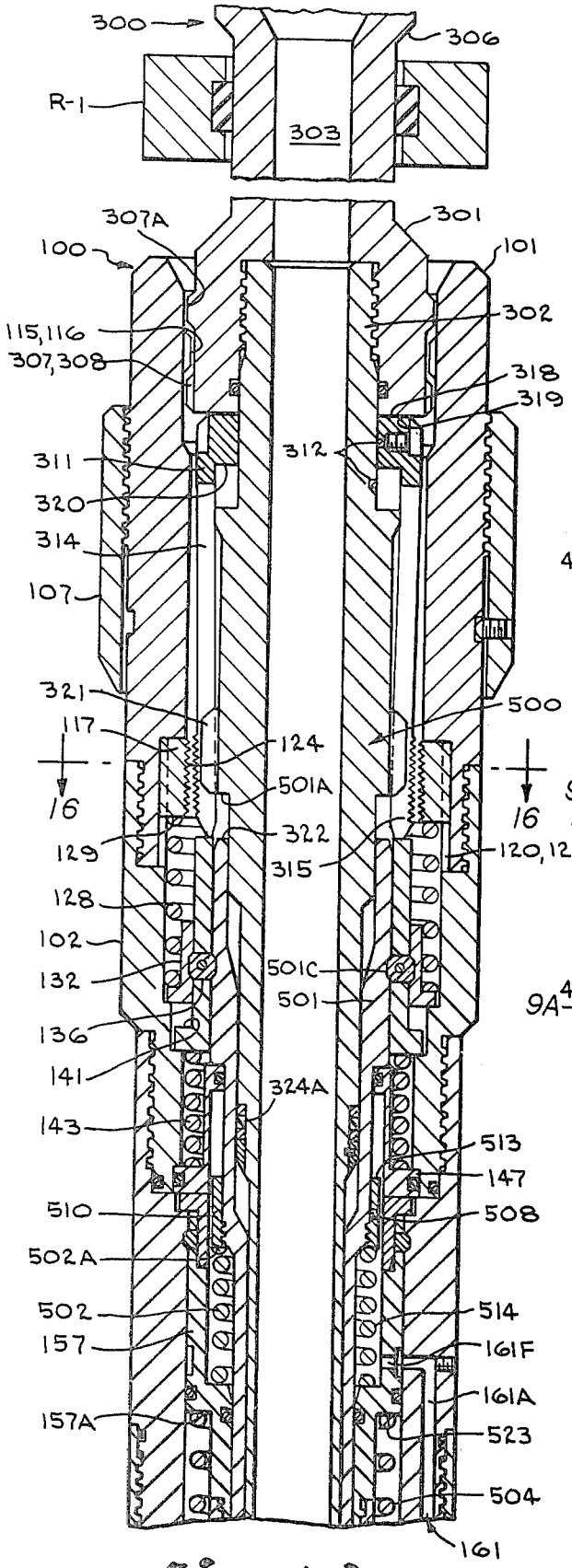
FIGS. 6A and 6B show the apparatus of the present invention during hydraulic releasing of the stab-in assembly from the outer housing, the collet being in unlatched relationship with respect to the floating nut and the ball valve being rotated to the closed position.
Figure 6B:
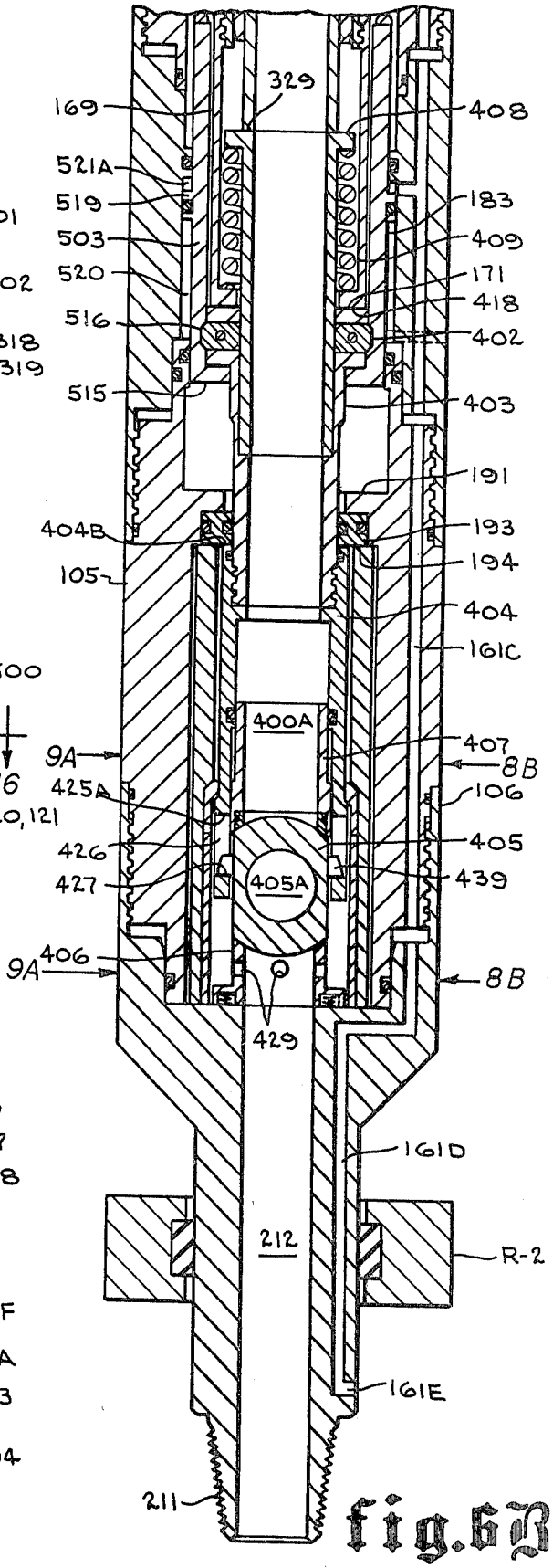

The latch housing 102 is secured to the spring housing 103 by means of threads 158, a circumferentially extending elastomeric O-ring seal 159 contained within its companion grooveway 160 within the lowermost end of the latch housing 102 preventing fluid communication between the latch housing 102 and the spring housing 103. A longitudinally and transverse passageway 161A' is defined interior of the spring housing 103, the passageway 161A' upwardly and initially communicating with a companion port 161F within the spring mandrel 157, the passageway 161A' flowing to a longitudinal companion passageway portion 161A extending downwardly thereof and, in turn, communicating with a passageway portion 161B cylindrically defined within the hydraulic housing 104 lowerly of the spring housing 103, the passageway continuing longitudinally downwardly from the portion 161B into a portion 161C contained and similarly defined within the valve housing 105 below the hydraulic housing 104, a passageway portion 161D within the bottom housing 106 communicating with the portion 161C thereabove, the passageway portion 161D having a lower opening 161E at the lowermost end of the bottom housing 106, the opening 161E functioning as a pressure vent which communicates to the well annulus. The passageway 161 and its component portions are functional in the hydraulic release of the stab-in assembly 300 from within the outer housing 100 as the upper and lower rams R-1 and R-2 are closed above the splined housing 101 and around the bottom housing 106, respectively, as illustrated in FIGS. 6A and 6B.

The spring housing 103 also contains a plug element 163 which is secured therein by means of threads 162, the plug 163 sealingly engaging a bore after the machining of the transverse passageway portion 161A'.

An O-ring seal element 164 is carried within its companion grooveway 165 on the spring mandrel 157 to prevent fluid communication between the spring mandrel 157 and the spring housing 103. Similarly, an elastomeric seal 166 is contained within its circumferentially extending grooveway 167 within the spring mandrel 157 to prevent fluid communication between the mandrel 157 and the latch sleeve 501 interior thereof.

The spring mandrel 157 is affixed by means of threads 168 to an elongated spring retainer housing 169 therebelow, the spring retainer housing 169 interiorly containing a compressive spring element 409 of the valve mechanism 400. The spring 409 has a lower end 412 which is received on an upwardly facing shoulder 170 of the spring retainer housing 169. A lower smooth face 171 is contained on the spring retainer housing 169, the lower face 171 defining the up stop to longitudinal travel of a lug mandrel 403 of the valve mechanism 400. Similarly, the lower end 172 of the spring mandrel 157 defines a stop against further upward movement of an upper valve mandrel 401 within the valve mechanism 400 as the valve mechanism 400 is manipulated upwardly.

Figures 3A, 3B:
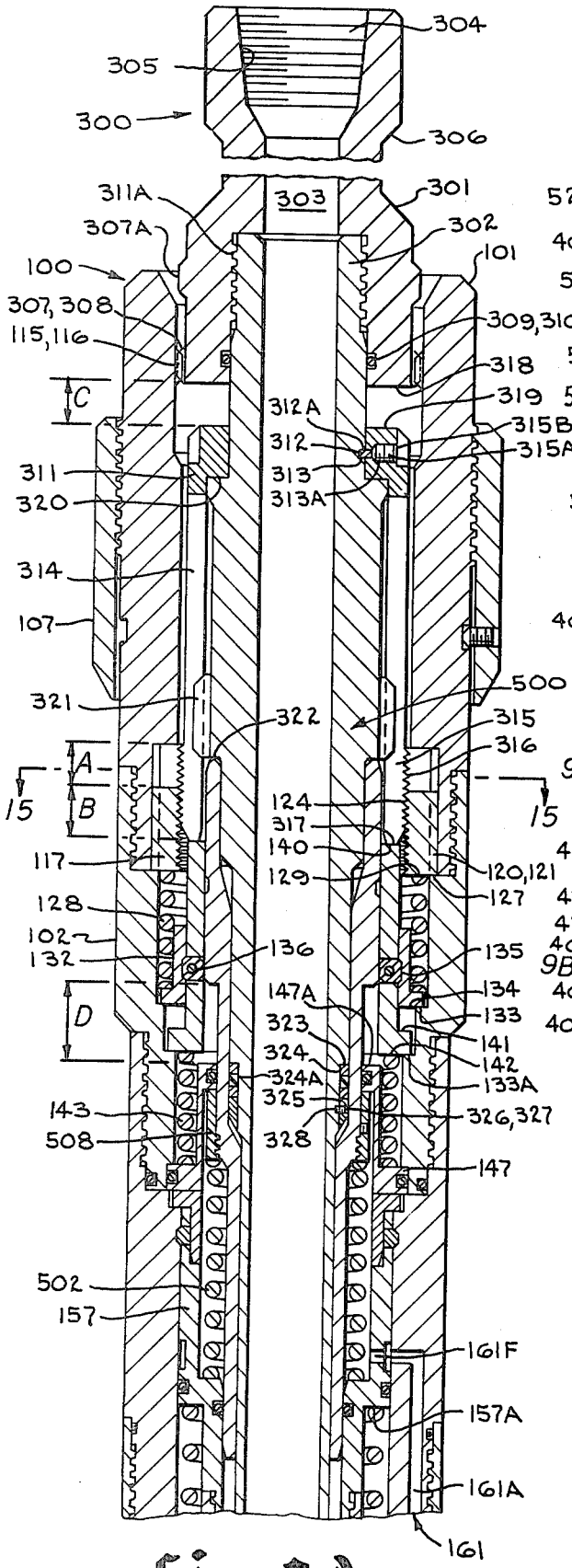
FIGS. 3A and 3B together constitute a longitudinal sectional view of the apparatus of the present invention with the stab-in assembly latched into the outer housing and the ball valve assembly in closed position.

It should be noted that when the stab-in assembly 300 is partially secured within the outer housing 100, before rotational and complete securement, as illustrated in FIG. 3B, the distance between the lower end 172 of the spring mandrel 157 and the upper end 408 of the upper valve mandrel 401 on the valve mechanism 400 is equal to a finite distance of 1¼ inches, which also is equal to the distance of initial free travel, the distance "F", between the ball 405 and the valve yoke 404.

An elastomer ring 173 is carried within its grooveway 174 on the spring housing 103 to prevent fluid communication between the housing 103 and the hydraulic housing 104 therebelow. Similarly, an O-ring 175 is contained within its circumferentially extending grooveway 176 defined within the spring housing 103, and also prevents fluid communication between the spring housing 103 and the hydraulic housing 104, the rings 173 and 175 being separated and between the longitudinal passageway portion 161A.

The hydraulic housing 104 is affixed to the spring housing 103 by means of threads 177, the exterior of the housing 104 containing a plug element 179 which is secured within the hydraulic housing 104 by means of threads 178, subsequent to the milling operation necessary to bore the transverse passageway portion 161B' thereacross. An elastomer ring 180 is carried within its circumferentially extending grooveway 181 in the housing 104 to prevent fluid communication from the interior of the housing 104 and a longitudinally extending hydraulic piston 503 carried interior of the housing 104.

Longitudinally extending below the plug 179 and milled through the housing 104 is an exteriorly opened bore 182 having an opening 182A for receipt of pressure from a kill or other line during the hydraulic releasing activation of the stab-in assembly 300, as described below, the bore 182 having an interior opening 182B communicating to a high pressure chamber 520 for longitudinal manipulation of the hydraulic piston 503 upwardly. A smooth inner diameter wall 183 is defined interior of the housing 104 for smooth sliding travel of a circumferentially extending exterior ring 517 carried around the hydraulic piston 503 as the piston 503 is shifted longitudinally upwardly during the hydraulic releasing operation, the wall 183 also defining the low pressure chamber 521A immediate the hydraulic piston 503 and above the piston head 519.

A valve housing 105, which contains the majority of components defining the valve mechanism 400, is secured lowerly of the hydraulic housing 104 by means of threads 184, an elastomer ring element 185 contained within a bore 186 defined exteriorly around the upper end of the housing 105 preventing fluid communication between the valve housing 105 and the hydraulic housing 104 thereabove, the ring 185 being exterior of the longitudinally extending passageway portion 161C bored through the valve housing 105. Similarly, a ring 187 carried within a groove 188 prevents fluid communication between the housings 104 and 105, and is interior of the passageway portions 161C and 161B. Additionally, an O-ring 189 carried within a circumferentially extending grooveway 190 in the valve housing 105 prevents fluid communication between the housing 105 and the hydraulic piston 503.

An inwardly protruding shoulder 191 on the housing 105 below the ring 189 normally is the seat for the lower end 515 of the hydraulic piston 503 as the piston 503 is urged downwardly and upon the shoulder 191 by the compressive force defined within the hydraulic sleeve spring 504. A similar but downwardly facing interiorly extending shoulder 192 blocks a stop ring 193, the stop ring 193, in turn, having a lower face 194 which, together with an abbreviated downwardly facing shoulder 197 on the housing 105, serves to define the upper seat for a longitudinally extending cylindrical top seat sleeve 200 which stabilizes the ball seat retainer 407 of the valve mechanism 400. The stop ring 193 contains an elastomer ring 195 within a grooveway 196 therefor to prevent fluid communication between the ring 193 and the interior of the valve housing 105, a similar elastomeric O-ring seal 198 carried within its grooveway 199 on the ring 193 preventing fluid communication between the ring 193 and an interiorly circumferentially extending cylindrical lug mandrel 403 of the valve mechanism 400.

The valve housing 105 also contains the top seat sleeve 200 which, again, has its upper end 201 shouldered against the companion shoulders 197 on the housing 105 and the lower face 194 of the stop ring 193. A beveled shoulder 201A extends inwardly on the top seat sleeve 200 to position the flange 434 of the valve mechanism 400 against upward movement during shifting of the valve yoke 404 to manipulate the ball 405 while the stab-in assembly 300 is being positioned within or removed from the outer housing 100.

An elastomer ring 202 within a groove 203 on the valve housing 105 prevents fluid communication between the housing 105 and the bottom housing 106, the ring 202 being carried on the housing 105 exterior of the passageway portion 161C. A similar ring 204 within its circumferentially extending grooveway 205 is carried interior of the passageway portion 161C on the valve housing 105, also to prevent fluid communication between the housings 105–106.

The bottom housing 106 carries the continual passageway portion 161D therethrough, a plug 208 being secured to the housing 106 by means of threads 207 to sealingly isolate the bore defined therein during the machining operation to define a transverse section of the passageway portion 161D. A similar plug 209 is secured within the housing 106 by threads 209A for plugging of the bore necessary to machine the longitudinal section of the passageway portion 161D in the housing 106. An upper face 210 on the housing 106 defines a shoulder for the lower end 432 of a compressed spring element 430 carried within a bore 431 on the ball seat element 406 immediately below the ball 405, the upper face 210 enabling the compressive force defined through the spring 430 to be upwardly urged to seal against the lower face of the ball 405.

The bottom housing 106 also defines a full opening interior 212 below the ball element 405 of the valve mechanism 400, and is open to a section of drill pipe DP therebelow which, in turn, is secured to the housing 106 at its lowermost end by means of threads 211. An opening 161E is contained within the housing 106 and defines the lowermost end of the passageway 161 and is open to the annulus of the well therebelow.

The stab-in assembly 300, which is received within the outer housing 100 through the open upper end 114, consists of a longitudinally extending cylindrical splined mandrel 301 which is affixed at its lower end to a companion longitudinally extending collet mandrel 302, the splined mandrel 301 and the collet mandrel 302 being affixed one to another by means of threads 311A.

The splined mandrel 301 has a full opening interior 303 for receipt of tools therethrough through the open upper end 304, the mandrel 301 being secured at its upper end by means of threads 305 to a tool joint or section of drill pipe DP thereabove. A beveled upwardly extending shoulder 306 is defined exteriorly around the splined mandrel 301 and functions as a lifting shoulder for a lifting nipple or a handling sub or elevator (not shown) for lowering of the stab-in assembly 300 and the outer housing 100 into the well, the elevators or other handling apparatus being secured around the exterior of the splined mandrel 301.

The lowermost end of the spline mandrel 301 contains an enlarged guide 307A circumferentially extending around the exterior of the mandrel 301 having a slightly larger diameter than the splineways 116 on the splined housing 101 therebelow, such that the guide 307A on the mandrel 301 never protrudes within the splineways 116 and is resisted from entering therein by the spaced splines 115 on the housing 101. Splines 307 interspaced between splineways 308 are circumferentially defined exteriorly around the mandrel 301 and below the guide 307A for respective intermeshing with the companion splineways 116 and splines 115 on the housing 101.

In order to prevent fluid communication between the splined mandrel 301 and the collet mandrel 302 therebelow, an elastomeric ring 309 is carried within a groove 310 on the splined mandrel 301.

As illustrated in FIGS. 3A and 3B, the collet mandrel 302, extending longitudinally below the splined mandrel 301, carries a collet assembly 311 thereon and exterior thereof, such that when the stab-in assembly 300 is secured within the outer housing 100, the collet assembly 311 is between the collet mandrel 302 and the splined housing 101 for selective engagement of the collet assembly 311 into the threads 124 of the floating latch nut 117. The collet assembly 311 is secured to the collet mandrel 302 by means of a transverse shear pin 312 having an end 312A extending within a companion groove 313 within the collet mandrel 302, the pin 312 having a preselectable shear rating up to the total weight of the drill string thereabove, the shear pin 312 holding the collet 311 in position such that the ball valve 405 is not rotated to the open position as the stab-in assembly 300 first is shifted longitudinally to position the collet 311 into the floating latch nut 117, the pin 312 being secured within the collet 311 by means of threads 313A. A set screw 315A is engaged within its companion bore 315B on the exterior of the shear pin 312 to properly secure it within the collet 311.

The collet assembly 311 consists of a plurality of elongated and inwardly flexible collet fingers 314, the fingers 314 being flexed inwardly, slightly, when not engaged within the floating lock nut 117. Each of the fingers 314 has at its lowermost end a spoon element 315 carrying threads 316 exteriorly thereon for companion engagement with lefthand threads 124 on the floating lock nut 117. A lower end 317 on each of the fingers 314 will, when the collet assembly 311 is partially and fully engaged within the nut 117, contact a companion upper end 140 on the lug sleeve 139 therebelow. The threads 316 on the spoons 315 are made up of upper and lower half sections defined as finite distance "A" and finite distance "B", respectively, each of the distances being equal to one another, and, as in FIG. 3A, $1\frac{1}{4}$ inches each, the threads 316 being secured to the threads 124 only to the extent of finite distance "B" during initial stab-in and prior to rotation of the ball 405.

As the collet assembly 311 is longitudinally and rotationally manipulated within the nut 117, the threads 316 will communicate with the threads 124 on the nut 117 lowerly and throughout the distance each of the finite distances "A" and "B", such that the stab-in assembly 300 activates the valve mechanism 400 to subsequently rotate the ball 405 to open position.

The collet assembly 311 has an upper end 319 which, when the shear pin 312 is engaged within the groove 313 of the collet mandrel 302, is longitudinally extended away by a finite distance "C" from a companion lower face 318 on the splined mandrel 301, the collet assembly 311 being permitted to travel the finite distance "C"

subsequent to the shearing of the pin 312 to disengage the collet assembly 311 from the collet mandrel 302.

The collet mandrel 302 also contains an outwardly extending upwardly facing shoulder 320 which is contacted as the result of the initial positioning of the collet assembly 311 when the pin 312 is not sheared. A plurality of outwardly extending collet guides 321 are positioned exterior of the collet mandrel 302 and between each of the fingers 314 of the collet assembly 311 to guide the fingers 314 and the spoon 315 into threadable positioning within the floating latch nut 117.

A downwardly facing shoulder 322 on the collet mandrel 302 also contacts the upper end 501A of the latch sleeve 501 to hold the sleeve 501 in longitudinal position relative to the lug sleeve 139 when the stab-in assembly 300 is positioned within the outer housing 101, initially, such that continued longitudinal downward travel of the collet assembly 311 enables the lower end 317 of the spoon 315 to urge the lug sleeve 139 and the latch sleeve 501 downwardly, until such time as the lug 136 is transferred to and within the groove 135 of the lug retainer 132, and the lug sleeve 139 shoulders downwardly on the latch housing 102 while the lug retainer lower face 134 contacts the down stop shoulder 133 of the housing 102.

The collet mandrel 302 also defines below a groove 323 a seal unit 324 which, in turn, comprises a circumferentially extending outwardly protruding elastomer seal 324A which is permitted to slide longitudinally along the smooth inner wall 501B of the latch sleeve 501 as the stab-in assembly 300 is manipulated in and out of the outer housing 100 of the apparatus A. When the stab-in assembly 300 is being disengaged from the outer housing 100 by hydraulic means and the splined mandrel 301 and the collet mandrel 302 are moved upwardly, hydraulic pressure interior of the housing 100 will be lost as the seal unit 324 comes out of its bore defined by the wall 501B and is placed above the bevel 505, resulting in a pressure drop interior of the outer housing 100, which is easily detectable at the controls on the semi-submersible or drill ship, or the like.

The seal 324A also seals off the drill pipe DP from the annulus of the well when the stab-in assembly 300 is affixed to the outer housing 100. It should also be noted that the seal 324A, in conjunction with the ring 151 immediate the latch sleeve stop 147, defines the upper end of the hydraulic pressure chamber 514 which acts in concert with a high hydraulic pressure chamber 520 utilized to hydraulically release the stab-in assembly 300 from the outer housing 100 during an emergency, as more fully described below.

As the seal 324A and O-ring 151 define the upper end of the low pressure chamber 514, the lower end thereof is defined by the rings 166 and 164 carried on the spring mandrel 157.

The seal unit 324 circumferentially extends around the exterior of the collet mandrel 302 and is prevented from sliding upwardly by means of the groove or shoulder 323 thereon, and is engaged and prevented from moving or sliding lowerly from stabilized position by means of a retainer element 325 which is secured to the collet mandrel 302 by means of a screw 327 protruding within a groove 328 on the mandrel 302 and secured within the retainer 325 by means of threads 326.

The stab-in assembly 300 terminates at its lower end 329 on the collet mandrel 302 which, when the stab-in assembly 300 is manipulated within the outer housing 100, contacts the upper end 408 of the upper valve mandrel 401 of the valve mechanism 400 to longitudinally shift the valve mechanism 400 for manipulation of the ball 405 between closed and open positions.

Referring now particularly to FIGS. 3B, 4B, 9A, 9B, 10, 11 and 12, the valve mechanism 400 consists of an upper valve mandrel 401 which provides an upper end 408 for contact by the lower end 329 of the collet mandrel 302 to direct manipulation of the valve mechanism. Additionally, the valve mechanism 400 continues longitudinally and lowerly of the upper valve mandrel 401 by means of a lug mandrel 403 which initially houses a lower lug 402 within a bore 415 on the mandrel 403, the lower lug 402 extending within a groove 414 on the mandrel 401 and being urged therein such that the upper valve mandrel 401 and the lug mandrel 403 initially travel longitudinally as a unit.

The lower lug 402, similar in construction and operation as the lug 136 carried within the lug sleeve 139, is secured within the lug mandrel 403 by means of a protruding pin 415A which, in turn, is received within a groove 416 in the lug mandrel 403, for stabilization.

The valve mechanism 400 continues lowerly of the lug mandrel 403 by means of a valve yoke 404 having an upper end 404B for interface with the lower face 194 of the ring 193 when the ball 405 and yoke 404 are positioned as in FIG. 2B, the yoke 404 being secured to the mandrel 403 by threads 420, an elastomeric O-ring seal element 422 being carried within a grooveway 421 on the valve yoke 404 to prevent fluid communication between the lug mandrel 403 and the valve yoke 404. The valve yoke 404 manipulates a ball element 405 having an interior passageway 405A therein which, when the ball 405 is manipulated to "open" position, communicates with the interior 212 therebelow and the interior 400A thereabove to permit passage therethrough of testing or other equipment.

The valve mechanism 400 also contains a ball seat retainer 407 interior of the valve yoke 404 having flanged sides 434, for receipt therethrough of the valve yoke 404.

A compressive spring element 409 is carried exterior of the upper valve mandrel 401 and may be classified as a main valve spring to actuate rotation of the ball 405, the spring 409 having an upper end 410 resting upon a shoulder 411 of the mandrel 401, and a lower end 412 resting upon the companion or protruding shoulder 170 on the spring retainer housing 169, the spring 409 normally urging the upper valve mandrel 401, the lug mandrel 403 and the valve yoke 404 upwardly, such that the ball 405 is rotated to closed position so that the ball interior 405A does not fluidly communicate with the interior section 212 therebelow and the interior section 400A thereabove, the spring 409 initially urging upon the upper end 408 of the upper valve mandrel 401 until the upper end 408 contacts the lower end 172 on the spring mandrel 157.

The lug mandrel 403 has an upper face 418 which will approach the lower face 171 of the spring retainer housing 169 when the stab-in assembly 300 is not within the outer housing 100. Similarly, the lug mandrel 403 also has defined below the lower lug 402 a lower face 419 which will approach a companion shoulder 515A on the hydraulic piston 503 as the valve mechanism 400 is shifted longitudinally downwardly by the stab-in assembly 300 to manipulate the ball to open position, the full travel distance between the upper face 419 on the lug mandrel 403 and the shoulder 515A on the hydraulic piston 503 being defined as finite distance "E", being illustrated in FIG. 2B as 2½ inches, or the amount sufficient to shift the valve yoke 404 from the initial neutral position to the completely down position to manipulate the ball 405 to the open position from the closed position, the distance "E" being equivalent to the finite distances "F" and "G" immediate the lower end of the valve yoke 404.

Figure 11:
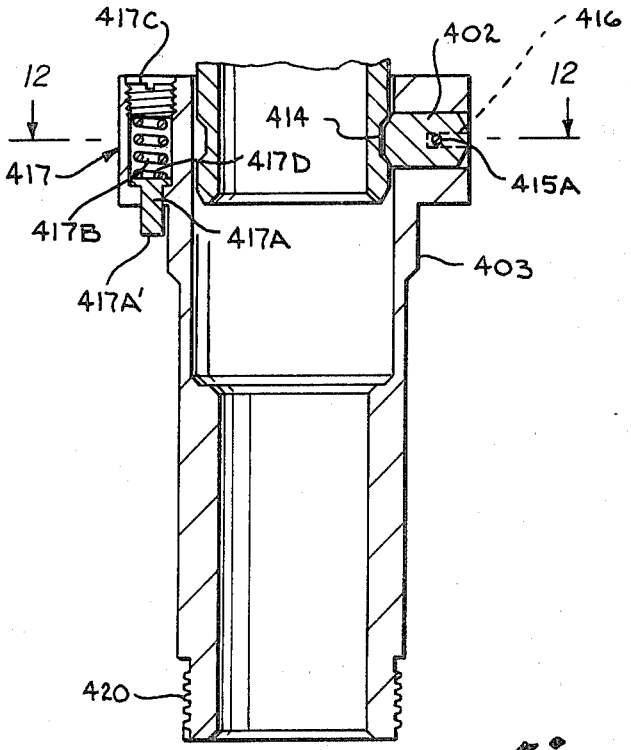
FIG. 11 is a longitudinal enlarged view of the plunger assembly and the lug mandrel taken along Lines 11—11 of FIG. 2B.
Figure 13:
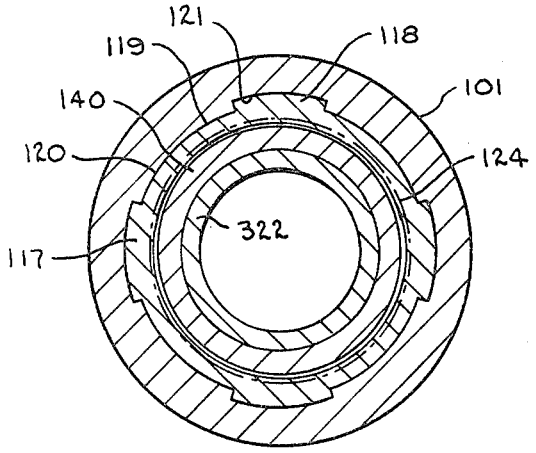
FIG. 13 is a cross-sectional view taken along lines 13—13 of FIG. 2A illustrating the relationship of the collet assembly and the floating nut.
Figure 14:
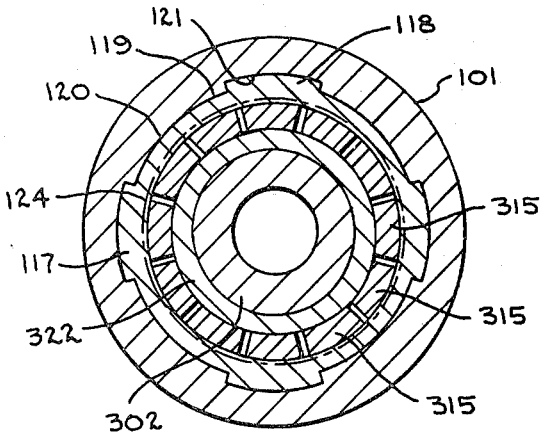
FIG. 14 is a view similar to that shown in FIG. 13 and is a cross-sectional view taken along Lines 14—14 of FIG. 5A.
Figure 15:
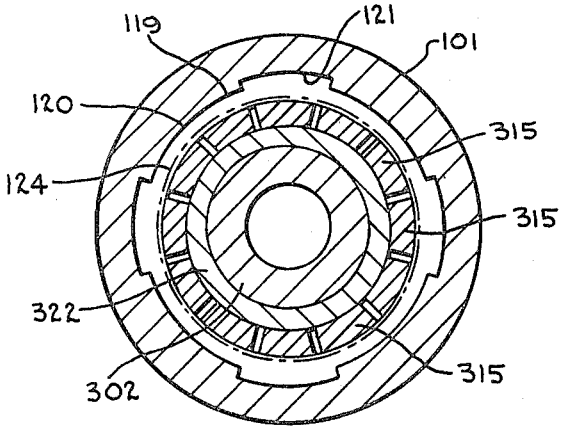
FIG. 15 is a view similar to those of FIGS. 13 and 14 and is a cross-sectional view taken along Lines 15—15 of FIG. 3A.
Figure 16:
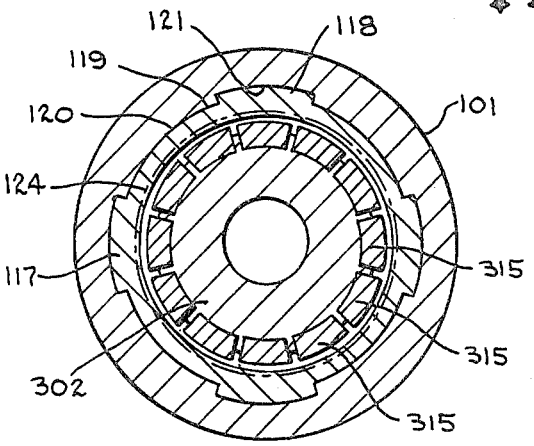
FIG. 16 is a cross-sectional view taken along Lines 16—16 of FIG. 6A.
Figure 17:
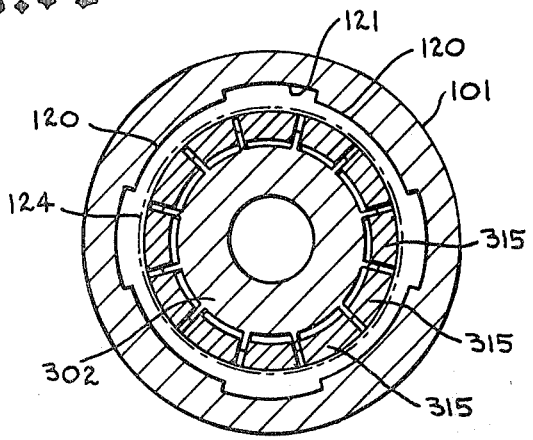
FIG. 17 is a cross-sectional view taken along Lines 17—17 of FIG. 7C.

Between each of the lower lugs 402, and defined on the lug mandrel 403 at a 45° offset from each of the lower lugs 402, is a plunger assembly 417, as seen in FIG. 11, which is provided to push the lug mandrel 403 up and away from the hydraulic piston 503 to assure that the lower lug 402 is not jammed and can shift back into its groove 414 in the upper valve mandrel 401 and from within the groove 516 on the piston 503 as the stab-in assembly 300 is being retrieved from the outer housing 100. Thus, the plunger assembly 417 functions as a positive force between the lug mandrel 403 and the hydraulic piston 503 when the lower lug 402 is shifted between the grooves 516 and 414. The plunger assembly 417 contains a plunger element 417A having a lower end 417A' resting upon the shoulder 515A when the lower lug 402 is within the groove 516, and the ball 405 is shifted to closed position during hydraulic activation. To obtain the "positive force" necessary to assure that the lug 402 is properly shifted from the groove 516, a compressed spring element 417B is placed interior of the plunger assembly 417 to act upon the top 417D of the plunger 417A, the upper end of the spring 417B securely resting upon a plug element 417C which, in turn, is threadedly affixed within the plunger assembly 417.

An elastomeric ring element 423 is contained within a groove 424 within the valve yoke 404 to prevent fluid communication between the valve yoke 404 and the ball seat retainer 407.

A cylindrical bottom seat sleeve 425 is carried within the top seat sleeve 200 and has its upper end 425A resting upon the flanges 434 of the ball seat retainer 407, the ball seat sleeve 425 holding the ball seat retainer 407 by means of the flanges 434 so that lower longitudinal travel of the ball seat retainer 407 is resisted.

The valve yoke 404 has its lower end which will approach a companion shoulder 406B on the ball seat 406 when the valve yoke 404 and the valve mechanism 400 are shifted to their lowermost position, the finite distance "G" between the lower end of the yoke 404 and the shoulder 406B being equivalent to the finite distance "F", i.e., 1¼ inches.

The finite distance "G" defines the last longitudinal travel distance of the valve mechanism 400 from the neutral position to the fully down position, when the ball 405 has been manipulated to the fully open position. Additionally, the finite distance "G" also defines the initial or neutral position of the valve mechanism 400 when it is desired to shift the ball 405 from the opened position to the closed position.

The finite distance "F" on the valve yoke 404 between the carriage pin 439 of the ball 405 and the lower end of the valve yoke 404 when the yoke 404 is in its uppermost position defines the distance necessary to shift the yoke 404 from the up position when the stab-in assembly 300 has been stabbed in to the outer housing 100 to the neutral position just prior to rotation of the drill pipe DP to completely manipulate the yoke 404 to open the ball 405.

The valve yoke 404 also contains an inner face 427 which engages with the carriage pin 439 to manipulate the ball 405 from the open position to the closed position. Additionally, an inner face 404A on the valve yoke 404 also engages the upper face of the carriage pin 439 when it is desired to shift the ball 405 from the closed position to the open position. The valve yoke 404 also contains a slot 426 for insertion therein of an exteriorly protruding carriage pin 439 carried on the ball 405 for manipulation of the ball 405.

Below the ball 405 is the ball seat 406 which has transversed therethrough a plurality of bores 429 to permit pressuring the drill pipe DP to increase pressure above the ball 405 before manipulating the ball 405 to the open position. A spring 430 is housed within a bore 431 and contains a lower end 432 resting upon the upper face 210 of the bottom housing 106 to urge the ball seat 406 against the exterior 405B of the ball 405, the ball seat 406 having a seal surface 406A which smoothly contacts the exterior 405B of the ball 405.

The ball seat retainer 407 contains at its lower end a seat element 435 housed within a groove 436 on the ball seat retainer 407, which is replaceable and interchangeable, an elastomeric O-ring seal element 437 being contained within a grooveway 438 on the seal 435 to prevent fluid communication between the seat 435 and the seat retainer 407. It should be noted that the ball seat retainer 407 stays stationary upwardly of the ball 405 by means of the seat 435 during rotation of the ball 405 between open and closed positions such that the retainer 407 "floats" on the exterior 405B of the ball 405 and is prevented from floating upwardly by means of the flanges 434 being, in turn, prevented from upward movement by the shoulder 201A on the top seat sleeve 200.

It should be noted that there is a small clearance between the lower end of the ball seat 406 and the upper face 210 of the bottom housing 106 so that if pressure is applied in the drill pipe, the ball 405 may be manipulated downwardly and fluid may be circulated around the ball 405.

Figure 4A:
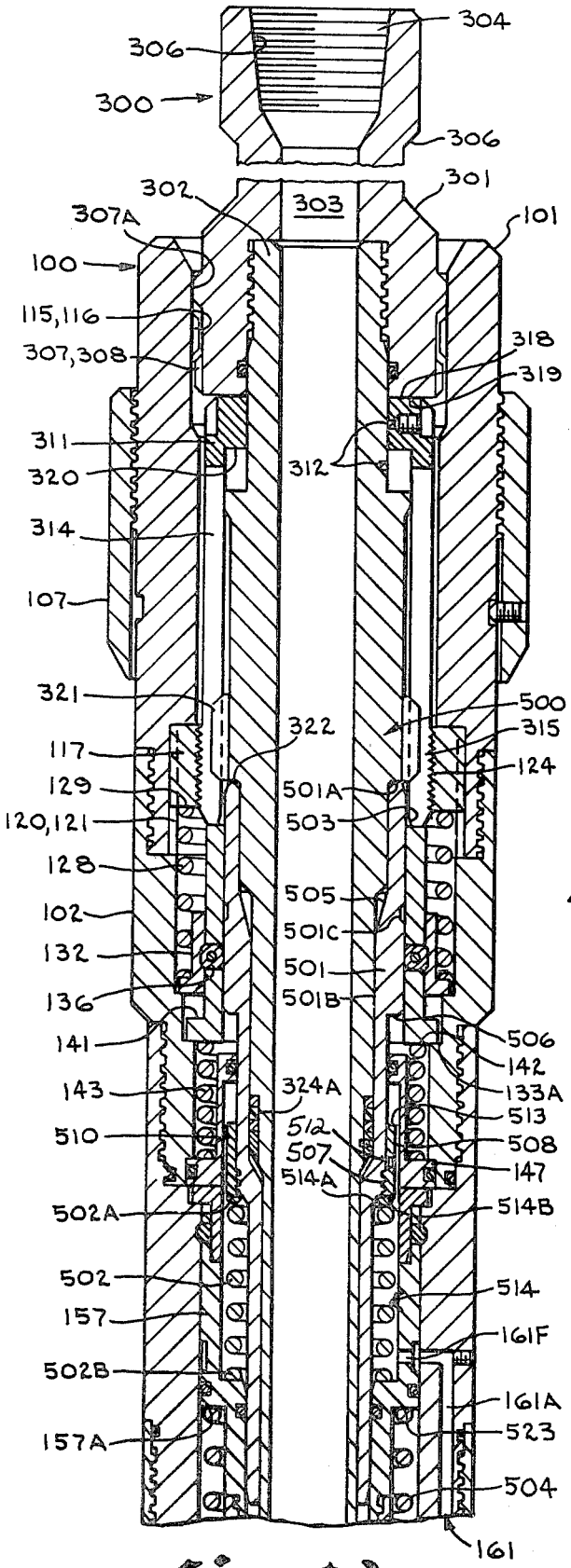
FIGS. 4A and 4B are views similar to those shown in FIGS. 3A and 3B, illustrating the stab-in assembly completely latched within the outer housing and the ball valve being completely manipulated to the open position.
Figure 4B:
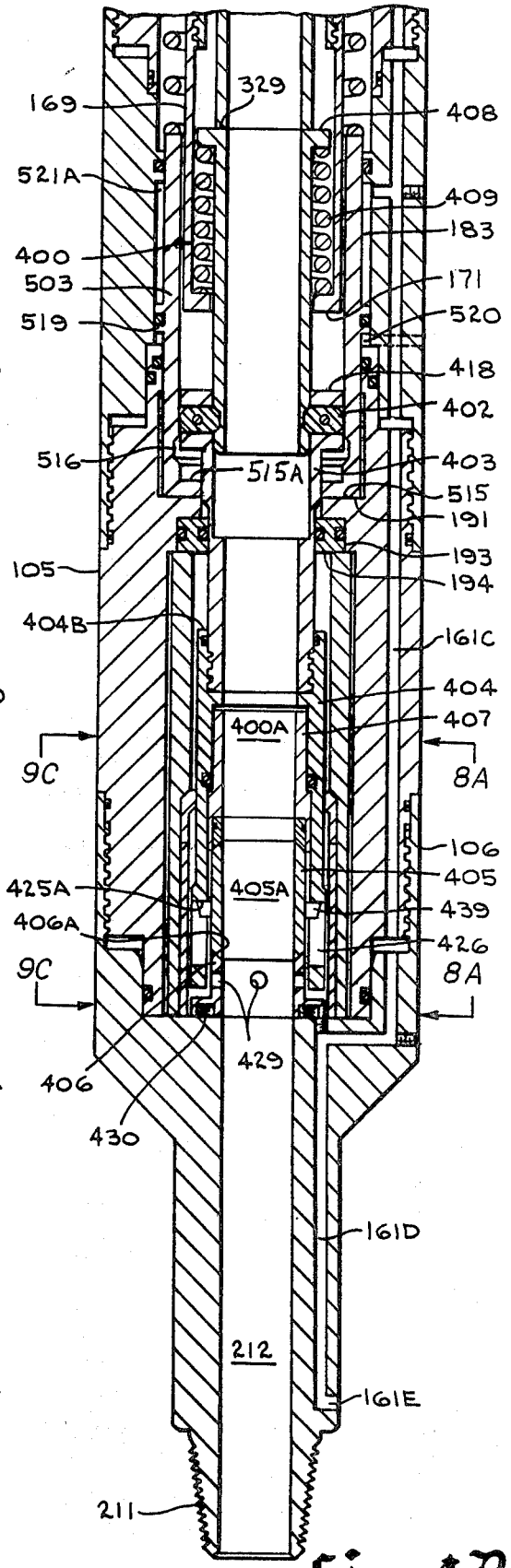

As depicted in, for example, FIGS. 4A and 4B, the hydraulic release mechanism 500 consists of a latch sleeve 501 which houses a main latch spring 502 which, in turn, urges the latch sleeve 501 upwardly and interior of the spoons 315 of the fingers 314 of the collet 311 when the stab-in assembly 300 is inserted within the outer housing 100 to assure that the spoon 315 does not become disengaged from along the threads 124 of the floating nut 117. Additionally, before the stab-in assembly 300 is inserted within the outer housing 100, the main latch spring 502 and the lug retainer spring 143 maintain the latch sleeve 501, and, in turn, the lug sleeve 139, in their uppermost position. The main latch spring 502 has its lower end 502B engaged upon the shoulder 157A of the spring mandrel 157 and has its upper end 502A urging upwardly against the shoulders 514A and 514B of the latch sleeve 501 and the latch sleeve nut 508, respectively. A low pressure chamber area 514 is defined around the spring 502 and between the spring mandrel 157, the lug retainer sleeve 153, and the latch sleeve stop 147, on its exterior side, and between the latch sleeve 501 on its interior side, the low pressure chamber or area 514 communicable with well annulus pressure by means of the port 161F which, in turn, communicates directly with the passageway 161 and its contiguous portions. The pressure contained within the low pressure chamber area 514 is equal to the hydrostatic pressure, or annulus pressure, in the well when the ram R-2 is closed and sealingly engaged upon the outer housing 100.

The latch sleeve 501 has an outer lip portion 503 which, when the collet 311 is engaged upon the floating nut 117, will prevent the spoon 315 from inward contraction and will direct it toward the lefthand threads 124 on the floating nut 117, thereby assuring proper securement of the threads 316 on the spoon 315 to the floating nut 117. The latch sleeve 501 also has its upper end 501A which will contact the shoulder 322 of the collet mandrel 302 when the lug 136 snaps out of its groove 501C, permitting the spring 502 to upwardly act upon the sleeve 501, as described below.

Immediate the groove 501C on the latch sleeve 501 is an upwardly beveled diametrically expanded shoulder 505 which, when the seal 324A of the seal unit 324 on the collet mandrel 302 is permitted to move to the shoulder 505, permits venting of pressure within the chamber 514 to indicate positively that the seal 324A has become sealingly disengaged from the wall 501A of the latch sleeve 501 and the stab-in assembly 300 has manipulated the ball 405 of the valve mechanism 400 to the closed position prior to the stab-in assembly 300 becoming unlatched from within the nut 117, during the hydraulic unlatching procedure.

The latch sleeve 501 also contains a shoulder 506 which, when the latch sleeve 501 and the stab-in assembly 300 have been manipulated from the latched position to the ball rotation position, shoulders in a no-go downward position against the upper end 147A of the latch sleeve stop 147, the total travel distance between the shoulder 506 and the upper end 147A, as shown in FIG. 3A, being defined as finite distance "D".

The latch sleeve 501 is secured by means of threads 507 to a latch sleeve nut 508 carried exteriorly therearound, the latch sleeve nut 508 acting as a stop for upper travel of the latch sleeve 501. The latch sleeve nut 508 also is secured to the latch sleeve 501 by means of set screws 511 secured within the latch sleeve nut 508 by means of threads 509 and received within a groove 512 on the latch sleeve 501.

The latch sleeve mechanism 500 also consists of a hydraulic piston 503 having its upper end 521 engaged by the lower end 522 of a hydraulic sleeve spring 504 which forces the hydraulic piston 503 in the down position or its lower initial operating position, the hydraulic sleeve spring 504 having an upper end 523 resting upon the downwardly facing shoulder of the spring mandrel 157. The piston has a head 519 which defines a low pressure chamber 521A thereabove and the high pressure chamber 520 therebelow. An elastomer ring 517 is carried on the piston head 519 and within a groove 518 and, as the head 519 is manipulated longitudinally, slides along the interior wall 183 of the hydraulic housing 104.

A lug slot 516 is defined on the piston 503 below the head 519 for selective receipt of the lug 402 to thereafter unitize the longitudinal travel of the piston 503 and the lug mandrel 403.

When the piston 503 is not activated, its lower end 515 will rest upon the shoulder 191 of the valve housing 105.

OPERATION

Figure 1:
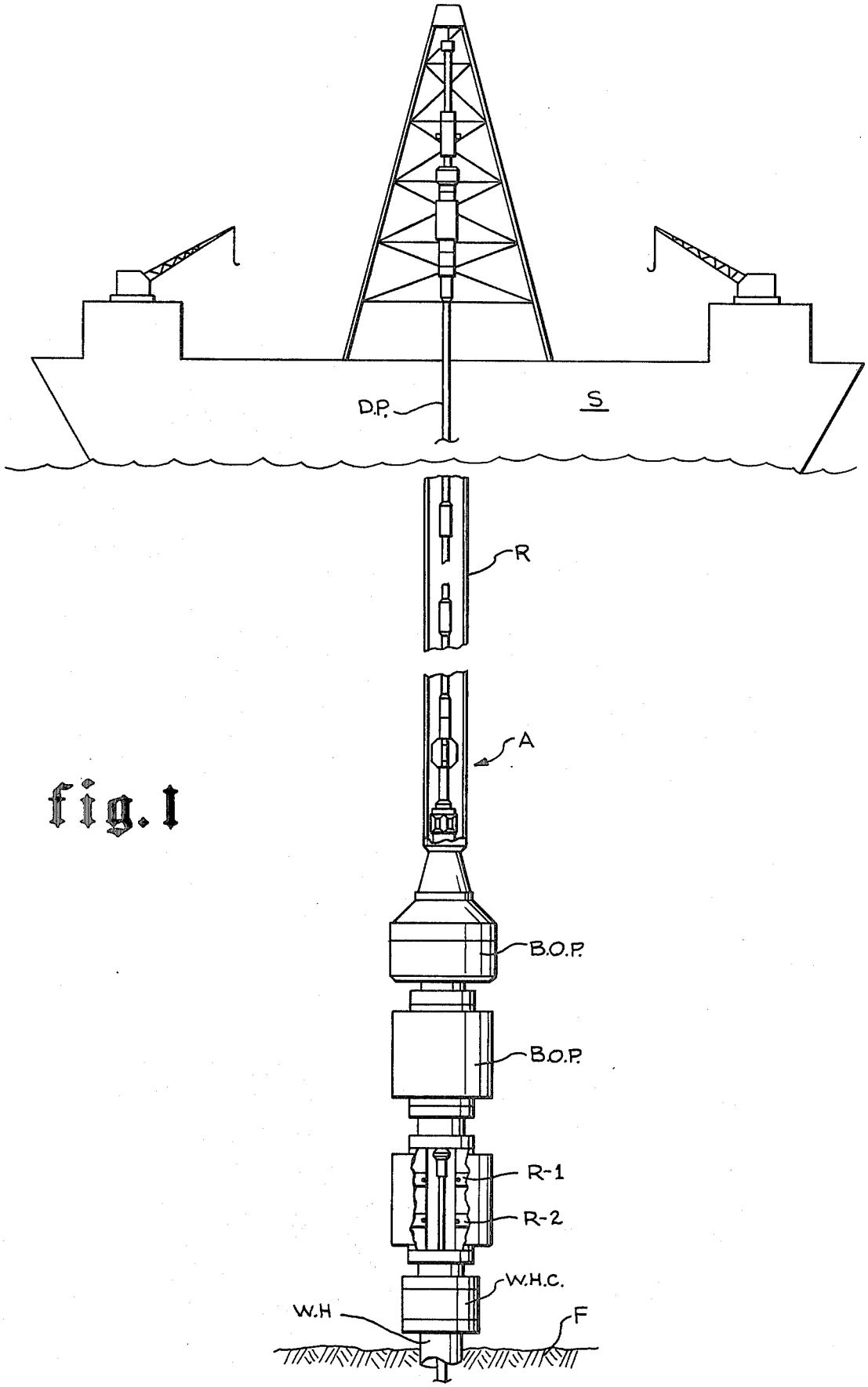
FIG. 1 is a schematic illustration of the present test tree assembly run on a string of drill pipe within a riser above a plurality of blowout preventers containing therein rams for affixation against the drill pipe, the blowout preventers being associated with a well head connector and well head above a formation penetrated by the drill pipe extending into the well therebelow.

Referring now to FIG. 1, the apparatus A is run on a string of drill pipe DP manipulated by conventional drilling apparatus aboard a semi-submersible S, the apparatus A on the drill pipe DP being carried within a riser R, and above first and second blowout preventers BOP. Rams R-1 and R-2 are as illustrated in FIG. 1 in open position within the lower BOP. A well head connector WHC is made up immediately below the rams R-1 and R-2 on the well head WH immediate the formation F.

As shown in FIGS. 2A and 2B, illustrating the outer housing 100 and component parts carried therein, prior to running of the stab-in assembly 300 therein and affixation of the apparatus A between sections of the drill pipe DP, the ball 405 is shown in closed position with inner face 427 of the valve yoke 404 being interfaced with the carriage pin 439. Also, the upper face 404B of the valve yoke 404 is interfaced with the lower face 194 of the stop ring 193. In this position, the lower lug 402 is carried within the groove 414 on the upper valve mandrel 401 which, in turn, has its upper end 408 shouldered against the lower end 172 of the spring mandrel 157.

The hydraulic piston 503 has its lower end 515 interfaced with the upperly facing shoulder 191 of the valve housing 105. The hydraulic piston 503 is held in this position by the interface of the lower end 522 of the hydraulic sleeve spring 504 being urged against the upper end 521 of the piston 503.

The latch sleeve 501 is held in its uppermost position by means of the compressive force defined through the spring 502 having its upper end 502A against the shoulder 514A of the sleeve 501, this force being resisted when the upper end 513 of the latch sleeve nut 508 encounters the lower facing shoulder 147B of the latch sleeve stop 147. In this position, the latch sleeve 501 also carries within its groove 501B the lug 136 housed within the lug sleeve 139 such that the latch sleeve 501 and lug sleeve 139 shift longitudinally as a single unit. Also, in this position, the lug retainer 132 has its lower face 134 against the shoulder 141 of the lug sleeve 139, with the lug 136 of the lug sleeve 139 out of and apart from the groove 135 of the lug retainer 132, the lug retainer 132 being urged toward the shoulder 141 by means of the compressive force within the spring 128 urging the end 130 of the spring 138 on the shoulder 131 of the retainer 132.

Also, in this position, the upper end 129 of the spring 128 is urged against the lower shoulder 125 of the latch nut 117 to place the latch nut 117 in its uppermost position with respect to the splined housing 101, such that the upper face 122 of the splined nut 117 is urged against the shoulder 123 of the splined housing 101.

With the outer housing 100 in the position as described above, and as illustrated in FIGS. 2A and 2B, the stab-in assembly 300 is inserted therethrough to the position as illustrated in FIGS. 3A and 3B, with the splined mandrel 301 having its upper end 304 affixed by means of thread 305 to a section of drill pipe DP thereabove, the lowermost end of the outer housing 100 being affixed by threads 211 to a lower section of drill pipe DP therebelow.

When the stab-in assembly 300 is inserted through the outer housing 100, the splineways 308 on the splined mandrel 301 are interengaged between the splines 115 on the splined housing 101, the guide shoulder 307A defining the lower limit of travel of the splined mandrel 301 through the splined housing 101. By interengagement of the splines 115 in the splineway 308, and the splines 307 in the splineways 116, the stab-in assembly 300 and the outer housing 100 may be rotated as a unit together with the drill pipe DP to, for example, activate a mud or other pump within the well to land and/or set an inflatable element or manipulate drill stem testing equipment, or the like.

When the apparatus A is to be run on the drill pipe DP, the stab-in assembly 300 is inserted into the outer housing 100 such that the valve yoke 404 is manipulated downwardly until the lower end 404A contacts the upper face of the carriage pin 439; however, the ball 405 is not manipulated to the open position, but, rather, remains in closed position, so that control of the well therebelow and through the drill pipe DP still may be maintained.

Referring now to FIGS. 3A and 3B, the stab-in assembly 300 is run into the outer housing 100 with the lower end 329 of the collet mandrel passing within and below the upper open end 114 of the outer housing 100. As stated previously, the splines 115 are permitted to travel within the splineways 308 on the splined mandrel 301. As the lower end 329 of the collet mandrel 302 passes within the outer housing 100, the end 329 will contact and engage the upper end 408 of the upper valve mandrel 401. Continued lower longitudinal movement of the splined mandrel 301 will cause contraction of the spring 409 such that the upper valve mandrel 401 and the lug mandrel 403, connected thereto by means of the lower lug 402 within the groove 414, will move downwardly, together with the valve yoke 404. When the lower ends 317 of the fingers 314 engage the upper end 140 of the lug sleeve 139 for compression of the spring 143, the latch sleeve 501 is separated from the lug sleeve 139 by means of the lug 131 being transversely shifted out of the groove 504 and into the groove 135 of the lug retainer 132 by the downwardly acting exertion applied by the stab-in assembly 300. As the fingers 314 and the splined mandrel 301 move downwardly, the latch sleeve 501 is stabilized by means of the upward urging force applied thereto through the spring 502. The lug sleeve 139 and the lug retainer 132 are enabled to shift longitudinally downwardly together as a unit until the lug retainer 132 shoulders against the shoulder 133 of the latch housing 102, permitting the lug 136 to be shortly thereafter shifted out of the groove 501C and into its companion groove 135 on the lug retainer 132, thereafter enabling the latch sleeve 501 to be snapped upwardly by the spring 502 against the collet mandrel 302. When the lower end 317 of the fingers 314 of the collet 311 contact the upper end 140 of the lug sleeve 139, the lug sleeve 139, together with the lug retainer 132, which is interassociated with the sleeve 139 by means of the lug 136 being partially housed within the groove 135, causes contraction of the spring 143 until the lower end 142 of the lug sleeve 139 interfaces with the shoulder 133A on the latch housing 102 and the lower face 134 of the lug retainer 132 rests upon the shoulder 133 of the housing 102. At this point, the interface of the lug sleeve 139 with the latch housing 102 prevents further lower longitudinal movement of the splined mandrel 301. Therefore, further lower longitudinal movement of the upper valve mandrel 401, the lug mandrel 403, and the valve yoke 404 is prevented, and the ball 405 is not rotated.

The unitized interengagement of the lug sleeve 139 and the lug retainer 132 together with downward movement of the stab-in assembly 300 enables the compressive force applied through the spring 128 to the nut 117 to be reduced, whereby the nut 117 is permitted to move downwardly with the fingers 314 upon interengagement of the threads 316 on the fingers 314 with the nut threads 124 on the nut 117. The nut 117 will be enabled to move downwardly by means of the splines 118 being carried within their companion splineways 119 on the splined housing 101. As the lower end 142 of the lug sleeve 139 encounters its companion upper shoulder 133A on the latch housing 102, thus defining the lower limits of longitudinal travel of the splined mandrel 301, the lower face 134 of the lug retainer 132 will rest upon the upwardly facing shoulder 133 on the latch housing 102.

As the lug sleeve 139 moves downwardly away from the latch nut 117, as described above, the spoons 315 of the fingers 314 on the collet 311 are enabled to pass across the latch nut 117 for interengagement of the threads 316 with the threads 124. Since the latch sleeve 501 is disengaged from the lug sleeve 139 because of the repositioning of the lug 136 within the groove 135 of the lug retainer 132, the spring 502 still will act upwardly upon the latch sleeve 501 to maintain the outer lip 503 immediate the inner diameter of the spoon 315 to assure proper co-engagement of the threads 316 and 124. As the threads 316-124 become interengaged, they will carry the floating latch nut 117 downwardly until shoulders 133 and 133A prevent further downward movement of the sleeve 139 and the retainer 132, such that the threads 316 engage approximately one-half the distance of the threads 124 on the nut 117.

It should be noted that when the collet 311 is latched into the floating latch nut 117, as described above, the latch nut 117 has moved down the finite distance "A" and the threads have interengaged the finite distance "B". Correspondingly, the lug mandrel has moved down one-half of the finite distance "E", and the ball valve yoke 404 has moved downwardly the finite distance "F".

In this stab-in position, again, as shown in FIGS. 3A and 3B, the apparatus A may be run on the drill pipe DP.

Prior to the time that it is desired to manipulate the ball 405 from the closed position to the open position, the drill pipe DP is pressure tested by increasing the pressure therein to monitor the pressure below the closed ball 405.

After the drill pipe DP has been pressure tested to assure that the ball 405 still remains in closed position, and, thus, that the well is under control, the apparatus A may be manipulated to rotate the ball 405 to the open position. The drill pipe DP is picked up such that the splined mandrel 301 moves longitudinally upwardly until further upward movement is prevented by the interface of the upper face 122 of the floating latch nut 117 with the lowerly facing shoulder 123 of the splined housing 101. The nut 117 has moved upwardly the finite distance "A". When the floating latch nut 117 is in this position, it should be noted that the lug sleeve 139 has been urged upwardly by the spring 143, and the upper end 140 thereof and the lower end 317 of the fingers 314 still are interfaced because of the force exerted by means of the spring 143 onto the lower end 142 of the lug sleeve 139. As the drill pipe DP is picked up, the latch sleeve 501 is enabled to move upwardly, correspondingly, by the compressive force within the spring 502 acting on the shoulders 514A and 514B. Since the sleeve 501 is enabled to shift upwardly, its interconnected parts also travel upwardly, the valve mandrel moving upwardly one-half the finite distance "E", and the ball valve yoke 404 moving upwardly the finite distance "F". Still, the ball remains closed.

Now, weight is applied to the drill pipe DP and the splined mandrel 301 is quickly shifted downwardly carrying the floating latch nut 117 along the splineway 121 until further downward movement is prevented by the interface of the lower end 142 of the lug sleeve 139 onto the upper shoulder 133A of the latch housing 102, the interface of the latch face 134 on the shoulder 133, and the face 125 of the nut 117 encountered the shoulder 127. When this occurs, shock load is carried through the lug sleeve 139 and the collet 311 to the shear pin 312, and this shock will cause the shear pin 312 to shear and separate, whereby the collet 311 no longer is pinned to the splined mandrel 301 and continued weight loading of the drill pipe DP will cause the finite distance "C" above the collet 311 to be closed as the upper end 319 of the collet 311 and the lower face 318 of the splined mandrel 301 are interfaced. As the collet 311 moves upwardly equal to the finite distance "C", the latch sleeve 501 has shifted downwardly one-half the finite distance "D", the lug mandrel 403 has moved down one-half the finite distance "E", the ball valve yoke has moved the finite distance "F", and the ball 405 will be manipulated to the open position. At this point, the upper end 319 of the collet 311 has shouldered against the lower face 318 of the splined mandrel 301, to close the finite distance "C". Because the collet 311 now is partially threaded into the floating latch nut 117, the collet mandrel 302 and the splined mandrel 301 are permitted to move longitudinally downwardly within the outer housing 100 a distance equal to the finite distance "C", thus further compressing the spring 409 and, thereby, moving the latch sleeve 501 down one-half the distance "D", shifting the upper valve mandrel 401 and the lug mandrel 403 an amount equal to one-half the finite distance "E", and the valve yoke 404 correspondingly downwardly equal to the finite distance "G" such that the yoke 404 manipulates the carriage pin 439 on the ball 405 to rotate the ball 405, and the ball interior 405A of the ball 405 now communicates with the interior 212 below the ball 405 and the interior 400A thereabove. This position is as shown in FIGS. 4A and 4B.

Thereafter, the drill pipe DP, together with the splined mandrel 301, are rotated to the left, with the collet guides 321 between each of the fingers 314 carrying the lefthand rotation of the splined mandrel 301 and transmitting this rotational force to the collet 311 to cause the threads 316 on the spoon 315 of the fingers 314 to complimentarily interengage with the additional and lower threads 124 on the floating latch nut 117 to an amount equal to the finite distance "A", in order to re-engage the splineway system between the stab-in assembly 300 and the outer housing 100. As lefthand rotation is continued, the lug sleeve 139 still will remain interfaced on the shoulder 133A of the latch housing 102, but the floating latch nut 117 will move upwardly along the splineway 119 until the upper face 122 thereof contacts the shoulder 123 on the splined housing 101.

Figure 5A:
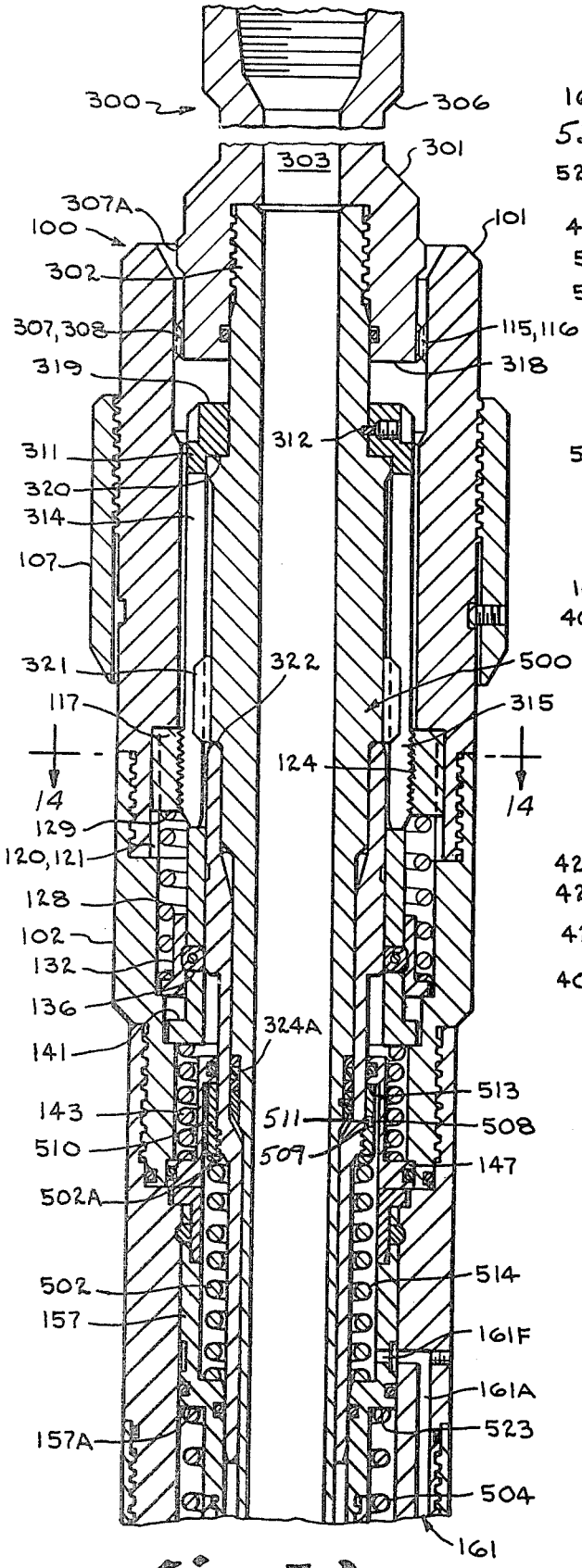
Figure 5B:
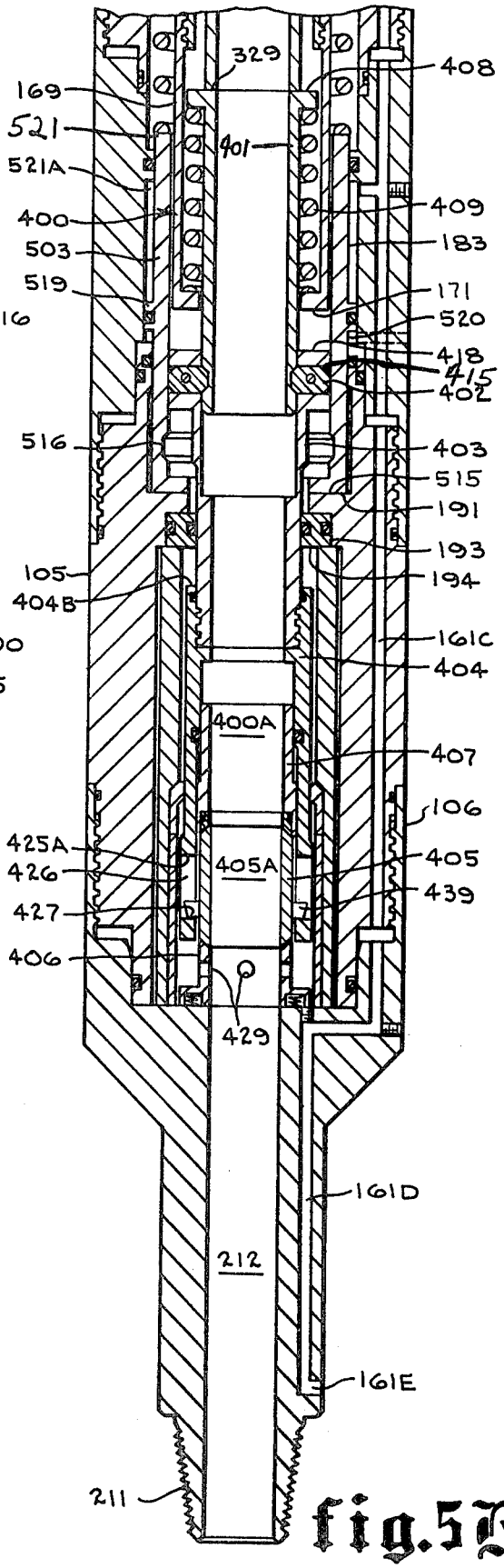

When it is desired to conduct testing operatings, such as drill stem testing, and the like, the apparatus A is manipulatable to the testing position as illustrated in FIGS. 5A and 5B by picking up on the drill pipe DP to longitudinally shift the stab-in assembly 300 upwardly with respect to the stabilized outer housing 100, until such time as the mandrel 302 has traveled a distance equal to finite distance "C", and the collet 311 has contacted the shoulder 320 on the mandrel 302, at which point the guide spline 307 has been moved away from the splines 115, and the splines 115-307 and splineways 116-308 will be respectively interfaced. Now, the stab-in assembly 300 and the outer housing 100 may be rotated with the drill pipe DP, as necessary, to apply rotational energy to manipulate a mud pump, or the like, or other drill stem test equipment.

In this position, it should be noted that the spoon 315 still is in complete engagement within the floating latch nut 117 with the threads 316 completely intermeshed with the nut threads 124. The lower end 317 of the fingers 314 still will rest upon the upper end 140 of the lug sleeve 139, such that the lower end 142 of the lug sleeve 139 continues to rest against the shoulder 133A of the latch housing 102, thereby compressing the spring 143 against the shoulder 146 of the latch sleeve stop 147. The 317-140 interface also will continue to urge the latch face 134 against the shoulder 133. However, the latch sleeve 501 has been urged upwardly one-half the finite distance "D" by the force of the spring 502, as the collet guide 321 and the mandrel 302 move up.

Additionally, in the test position, the lower end 329 of the collet mandrel 302 still rests against the upper end 408 of the mandrel 401, urging it to compress the spring 409 contained interior thereof. Concurrently, the upper valve mandrel 401, being interfaced with the lower lug 402 and the lug mandrel 403, together with the valve yoke 404, has been moved upwardly, slightly, an amount equal to one-half the finite distance "E" and the complete finite distance "G" immediate the carriage pin 439 of the ball 409. However, the movement of the valve yoke 404 and its interrelated parts with respect to the ball 405 the extent of the finite distance "G", is insufficient to manipulate the ball 405 to the closed position, and the yoke 404 still is in a neutral position with respect to the ball 405.

In this position, the inner face 427 of the valve yoke 404 now rests against the lower face or end of the carriage pin 439 of the ball 405.

After the drill pipe DP or other components of the well have been tested, the stab-in assembly 300 may be withdrawn from within the outer housing 100 by withdrawing the drill pipe DP. The lower ram R-2 is first manipulated to the closed position around the outer housing 100.

Figure 7A:
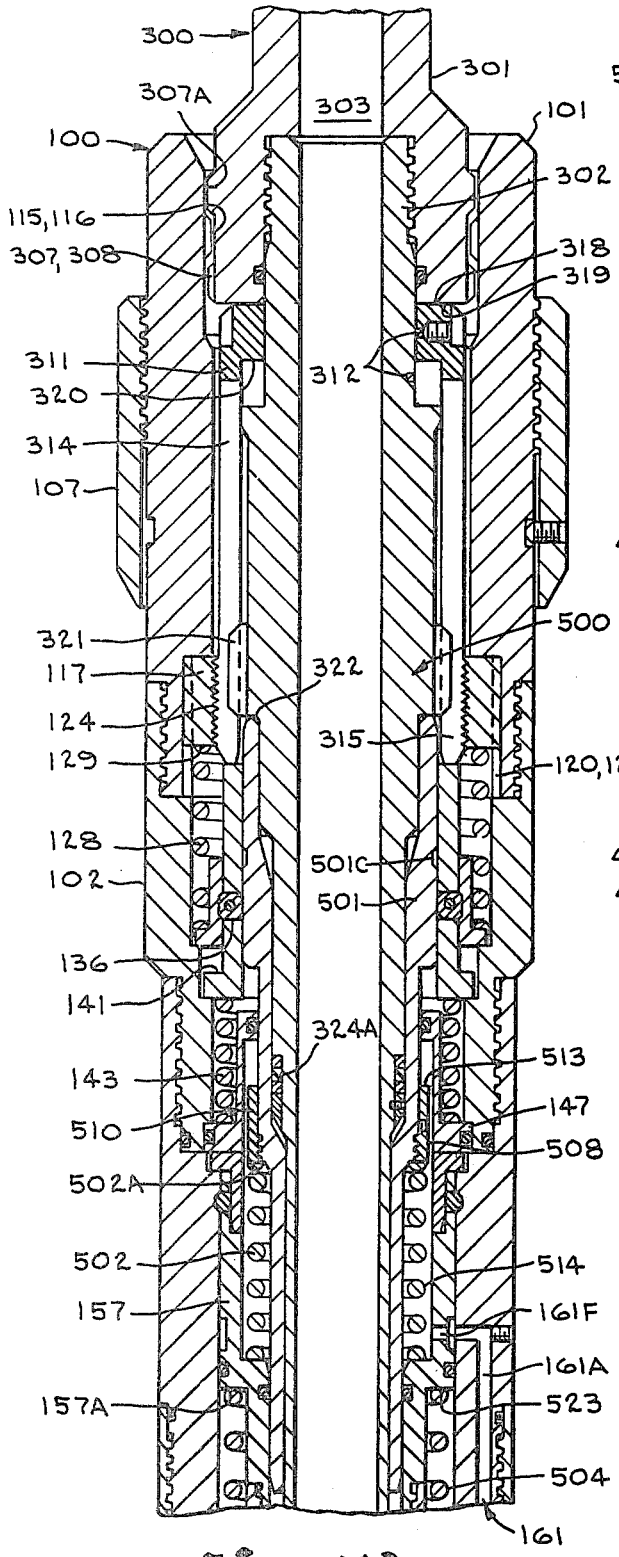
FIGS. 7A and 7B illustrate the apparatus during mechanical release of the stab-in assembly from the outer housing, and particularly illustrating the first stage of the mechanical release mode by showing the drill pipe being set down with the ball valve remaining in the open position, and the stab-in assembly latched to the outer housing.
Figure 7B:
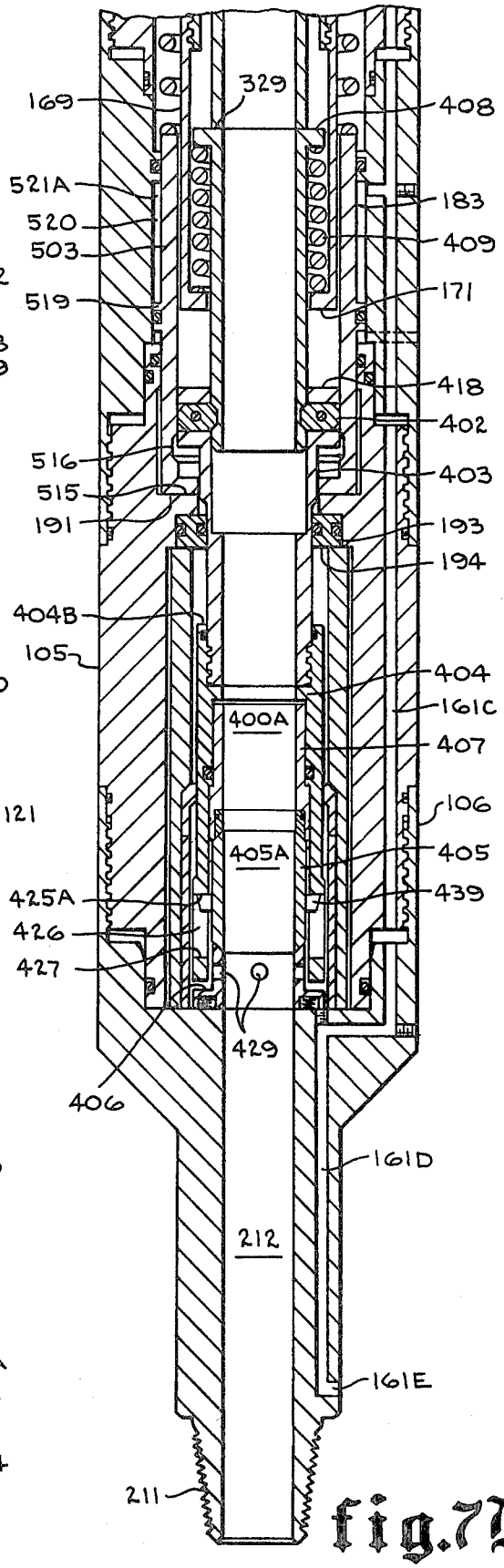

Referring to FIGS. 7A and 7B, the stab-in assembly 300 may be mechanically disengaged from the outer housing 100 by first applying weight to the drill pipe DP and through the splined mandrel 301 such that the splines 115–307 become respectfully disengaged from within the splineways 116–308 and move out of interlocking engagement as the stab-in assmebly 300 moves downwardly with respect to the stabilized outer housing 100. The stab-in assembly 300 will continue to move downwardly until such time as the upper end 319 of the collet 311 resists and prevents further downward travel of the splined mandrel 301 by interfacing with the lower face 318 of the splined mandrel 301. Because the collet lower end 317 is interfaced on the upper end 140 of the lug sleeve 139, which, in turn, is shouldered against the latch housing 102 at the interface thereof with the lower end 142, further downward longitudinal movement of the stab-in assembly 300 is prevented. Now, the mandrel 302 has moved downwardly with respect to the stabilized collet 311 a length equivalent to finite distance "C". The latch sleeve 501 has been carried downwardly one-half the finite distance "D", and, in turn, the upper valve mandrel 401 has shifted downwardly one-half the finites distance "E", together with the yoke 404, which has moved down around the carriage pin 439 a distance equivalent to finite distance "F". In this position, the valve yoke 404 has been manipulated downwardly to the original neutral position such that the upper shoulder 428 of the yoke 404 now contacts the carriage pin 439. However, because the stab-in assembly has only traveled an amount equal to each of the finite distances "C" and "F", and only one-half the finite distances "D" and "E", the downward movement does not cause the valve yoke 404 to rotate the ball 405 to the closed position.

Accordingly, in order to rotate the ball 405 to the closed position, the drill pipe DP, together with the stab-in assembly 300, are rotated to the right in order that the threads 316 may become partially disengaged from the threads 124 on the floating latch nut 117. As righthand rotation continues, the floating latch nut 117 moves downwardly until the lower shoulder 125 thereof no-goes with the upper shoulder 127 of the latch housing 102, thus preventing further righthand rotational movement.

Figure 7C:
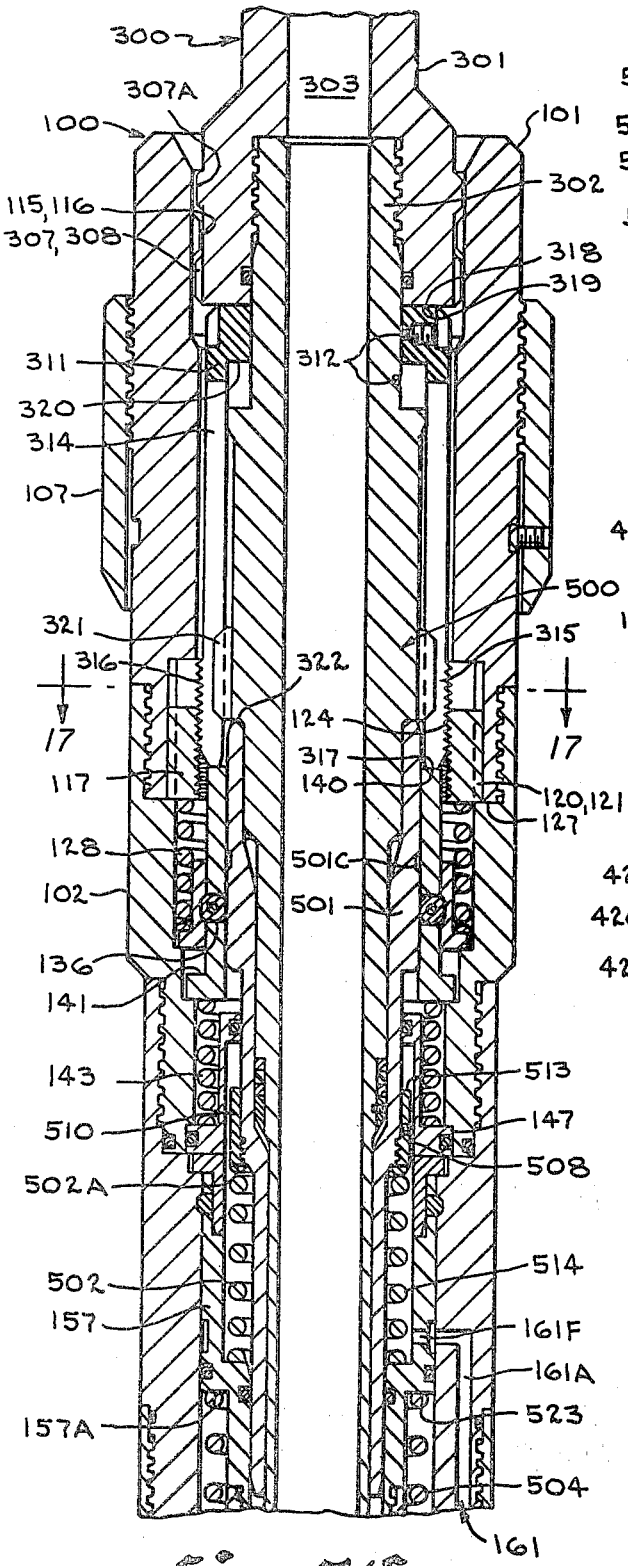
FIGS. 7C and 7D together constitute a longitudinal sectional view similar to that shown in FIGS. 7A and 7B during mechanical releasing of the stab-in assembly from the outer housing, FIGS. 7C and 7D particularizing the positioning of the apparatus as the drill pipe is being rotated to unlatch the collet assembly with respect to the floating nut.
Figure 7D:
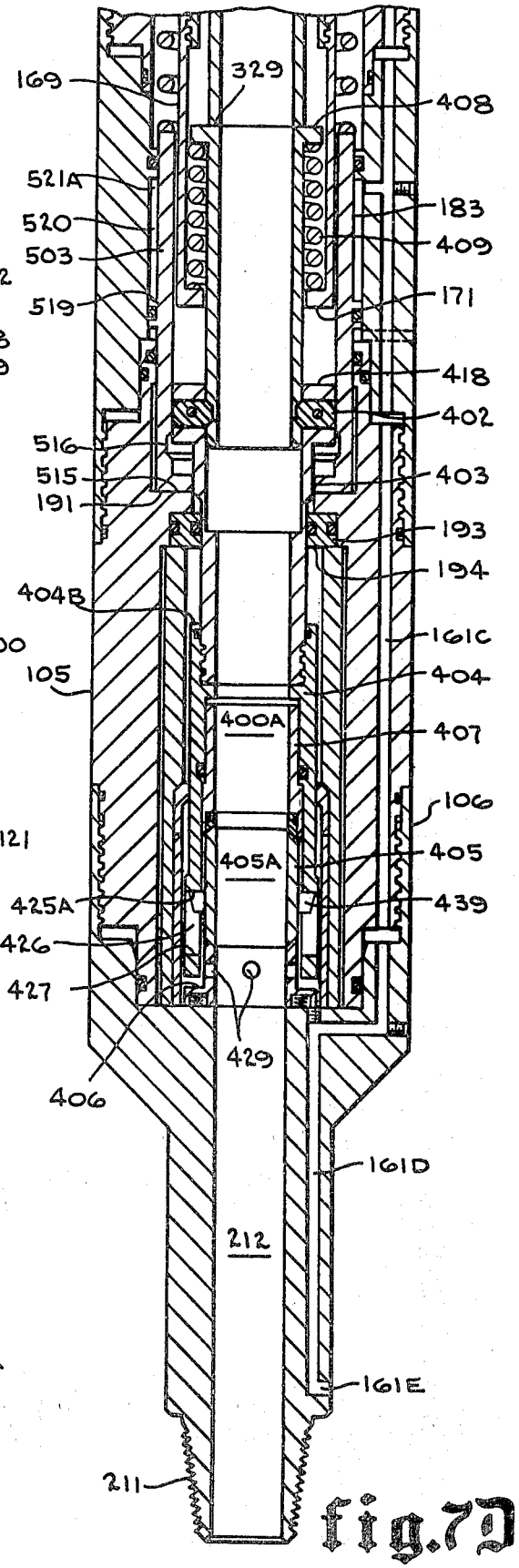
Figure 7E:
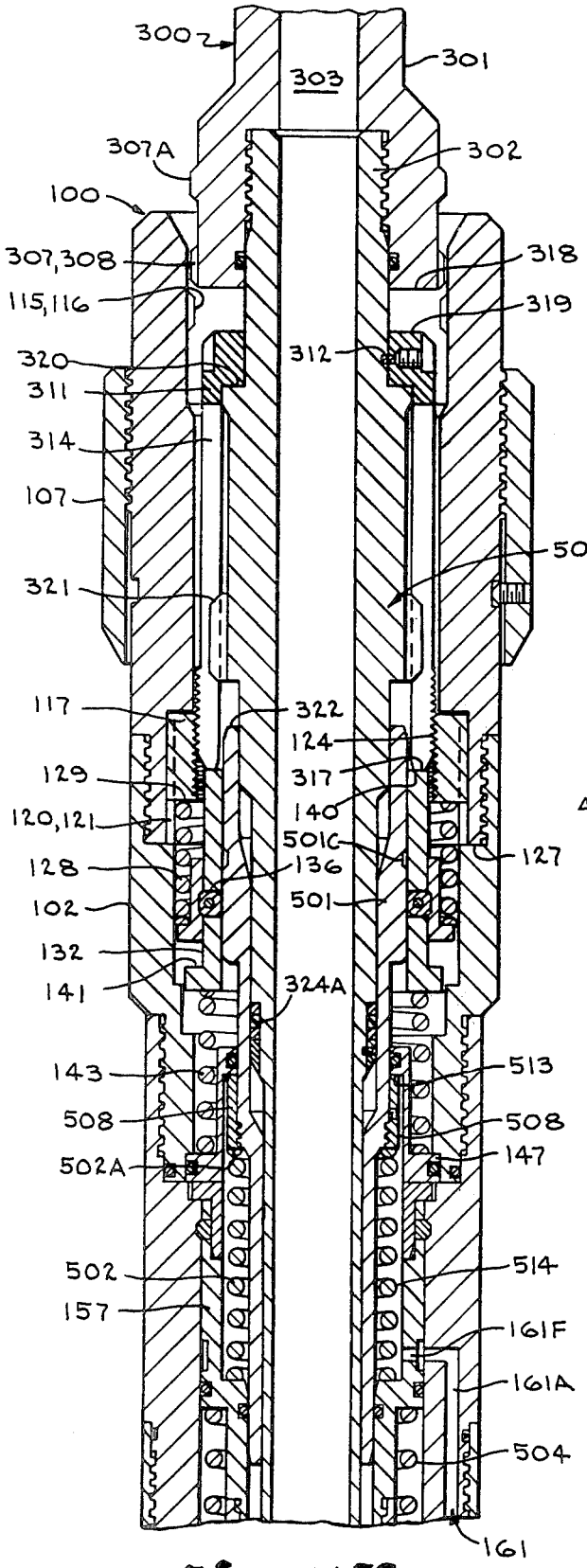
FIGS. 7E and 7F are longitudinal sectional views similar to those shown in FIGS. 7A, 7B, 7C and 7D, illustrating the mechanical release of the stab-in assembly with respect to the outer housing, FIGS. 7E and 7F particularizing the positioning of the component parts of the apparatus as the drill pipe is being picked up.
Figure 7F:
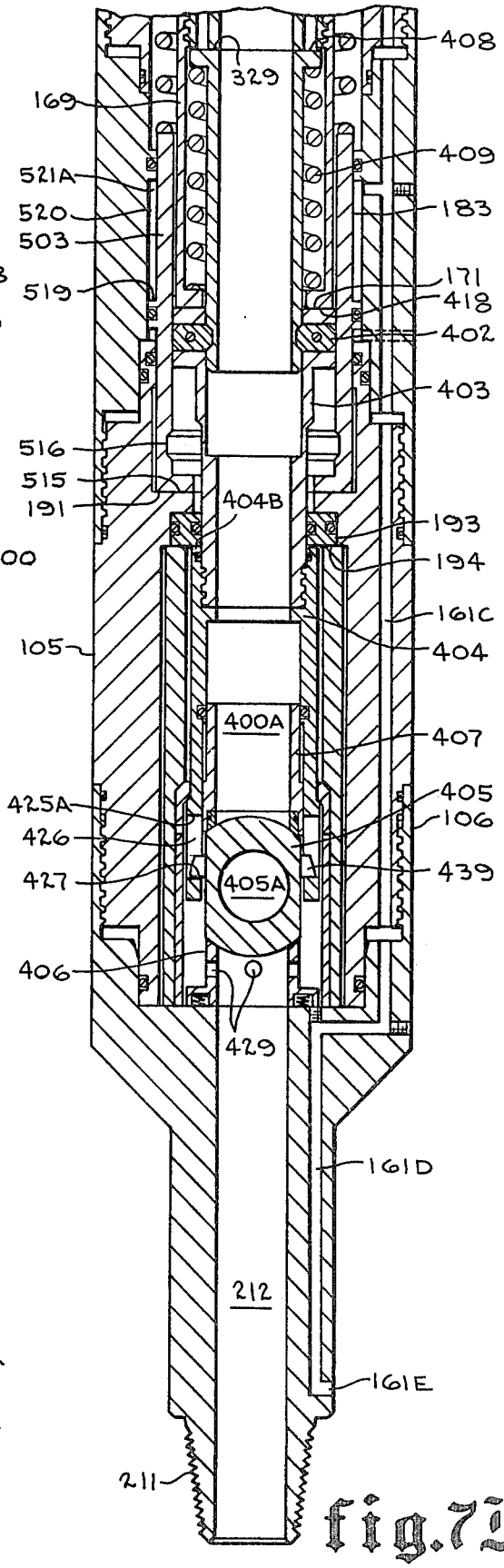
Figure 8A:
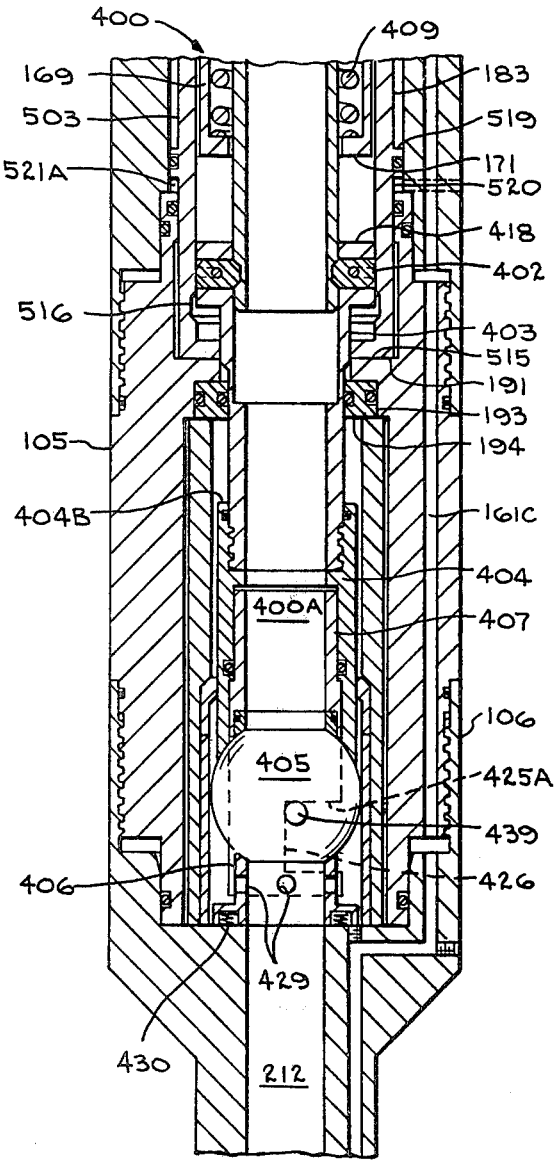
FIG. 8A is a sectional side view taken along Lines 8A—8A of FIG. 4B, illustrating the ball valve in open position and the yoke in the completely down position.
Figure 8B:
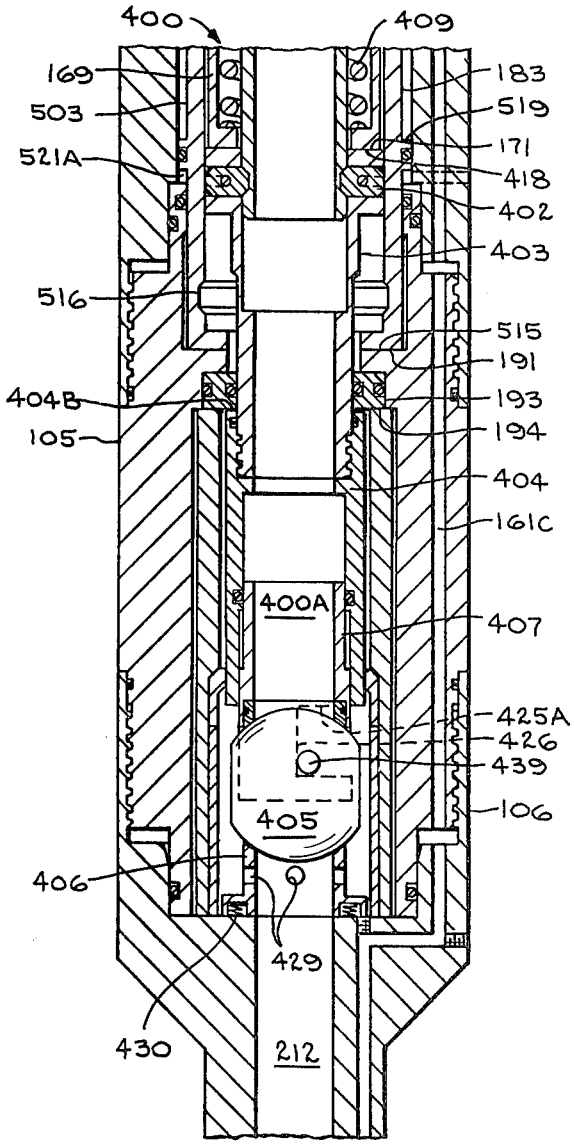
FIG. 8B is a view similar to that shown in FIG. 8A and is taken along Lines 8B—8B of FIG. 6B, illustrating the ball valve manipulated to the completely closed position and the yoke in the completely up position.
Figure 9A:
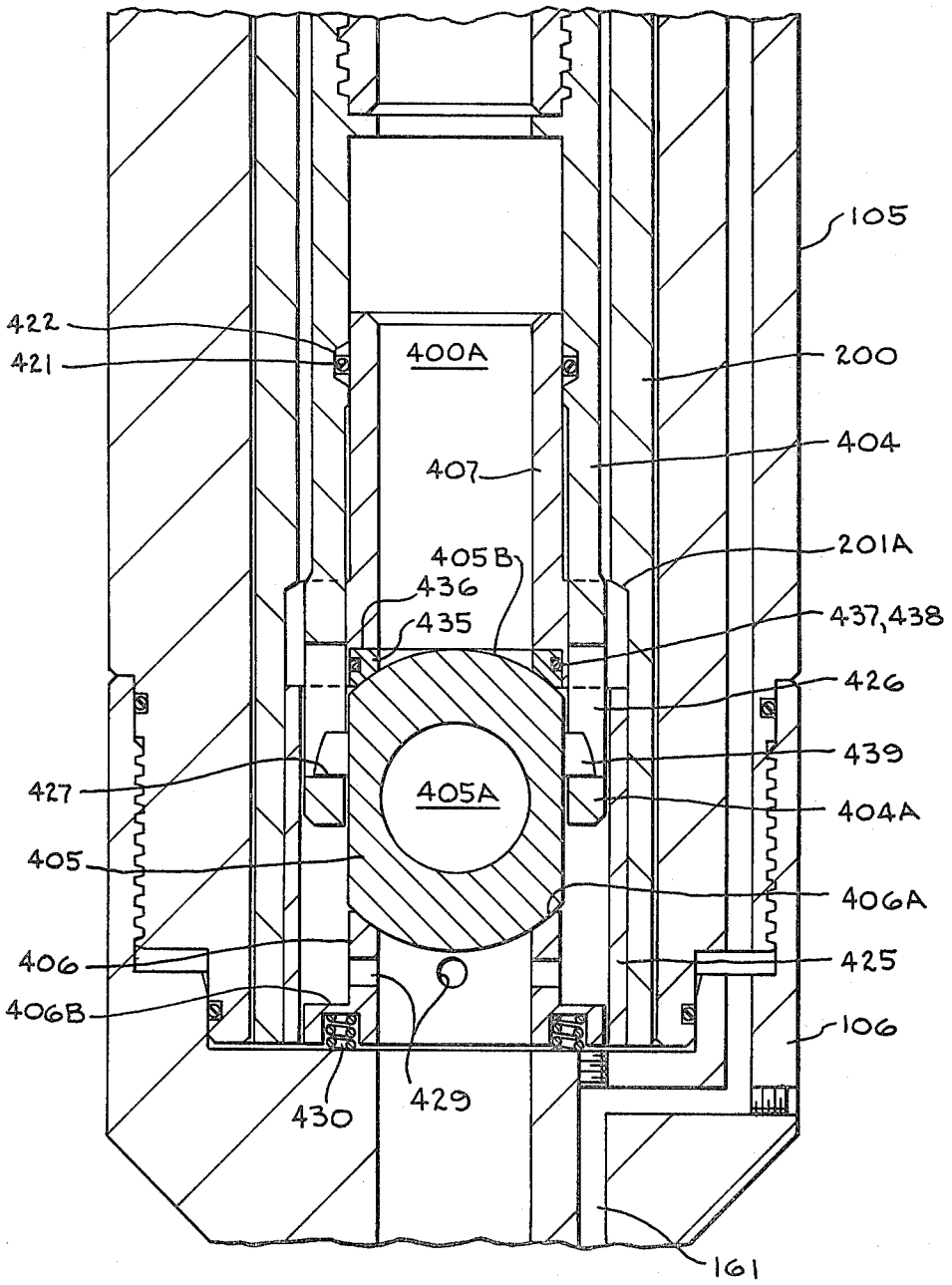
FIG. 9A is an enlarged longitudinal sectional view taken along Lines 9A—9A of FIG. 6B illustrating the ball valve in closed position and the yoke in the completely up position, and particularly illustrating the ball and seat assembly.
Figure 9B:
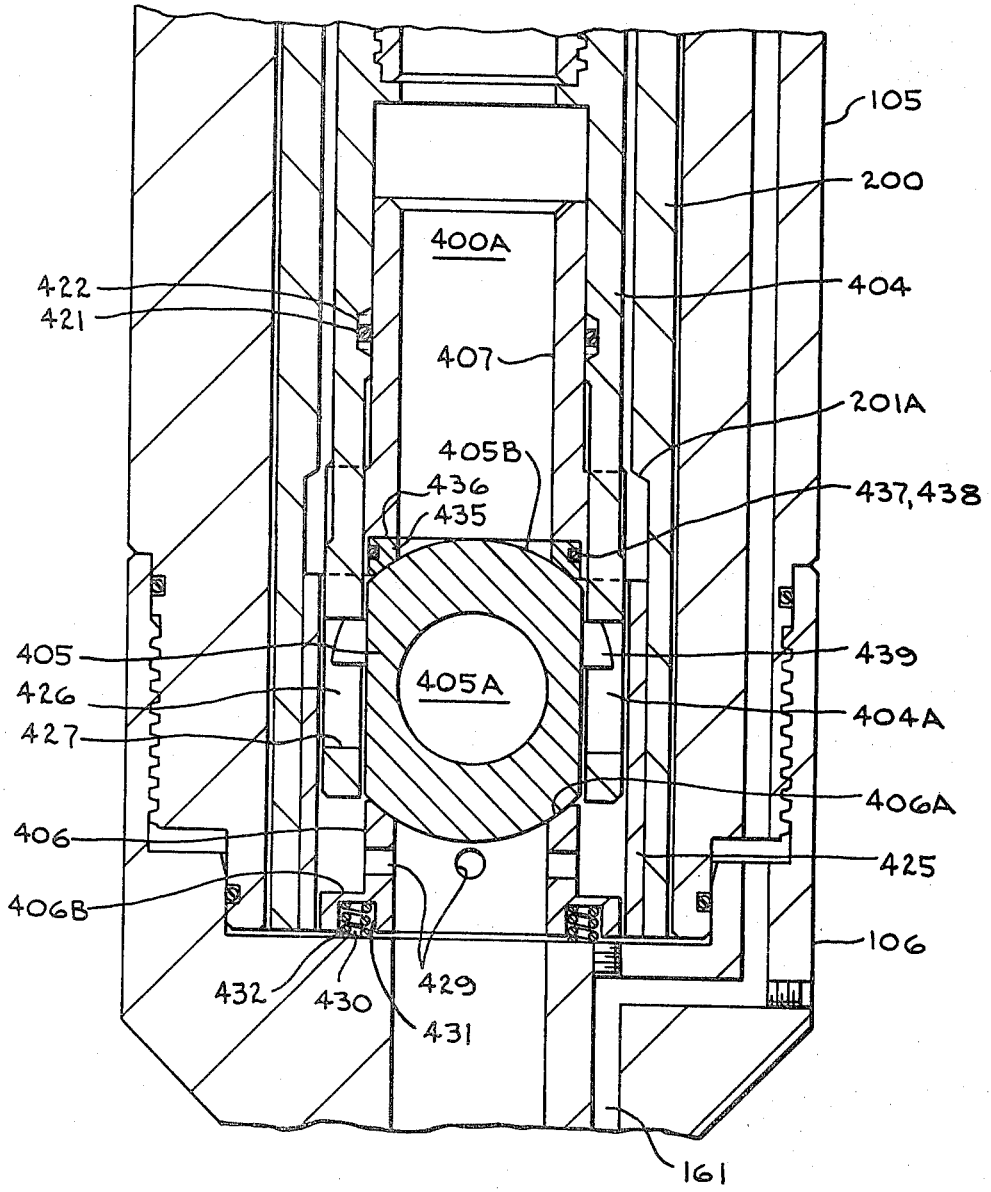
FIG. 9B is a view similar to that illustrated in FIG. 9A showing the ball valve in the closed position with the yoke in its neutral position, FIG. 9B being a view taken along Lines 9B—9B of FIG. 3B.
Figure 9C:
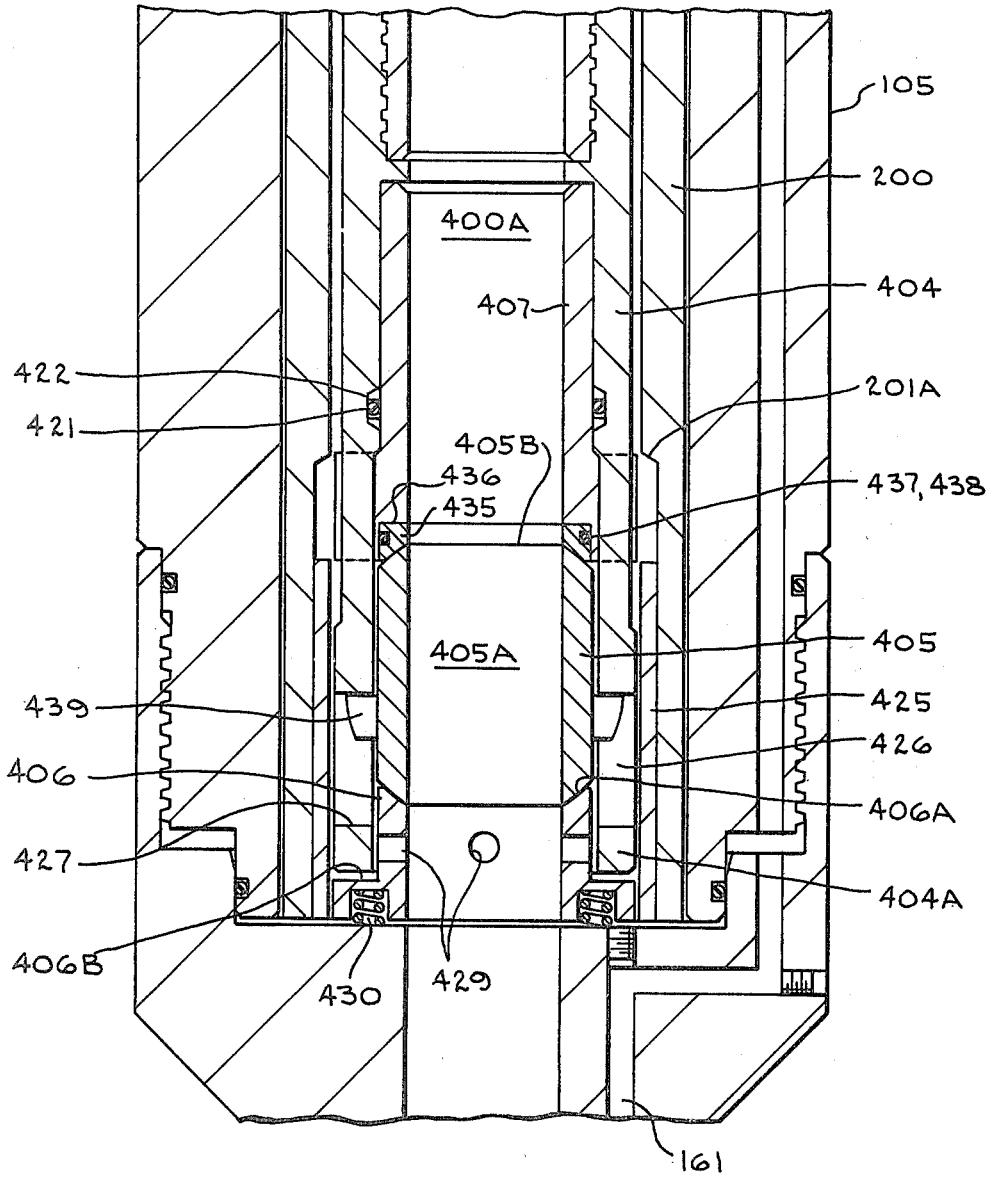
FIG. 9C is a view similar to those shown in FIGS. 9A and 9B, FIG. 9C being taken along Lines 9C—9C of FIG. 4B, and illustrating the ball valve in open position with the yoke being shifted to its lowermost position.
Figure 12:
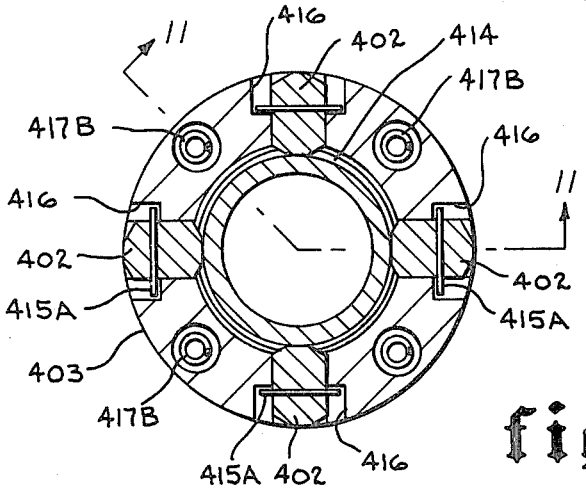
FIG. 12 is a cross-sectional view taken along Lines 12—12 of FIG. 11 illustrating the lug affixed to the valve mandrel and the plunger assembly interspaced therebetween.

As shown in FIGS. 7C and 7D, rotational movement as described above does not affect the position of the mandrel 302 or any of its interrelated parts, including the valve yoke 404. However, the threads between the spoon 315 and the nut 117 have become disengaged to an amount equal to finite distance "B".

After the drill pipe DP has been rotated to the right and the lower shoulder 125 of the floating latch nut 117 is interfaced with the upper shoulder 127 of the latch housing 102, the drill pipe DP again is picked up, thus carrying the stab-in assembly 300 with it. Now, because the fingers 314 have not flexed inwardly around the collet guides 321 because of the position of the latch sleeve 501, the threads 316 and 124 still are sufficiently frictionly interengaged along finite distance "A", to carry the floating latch nut 117 upwardly therewith until the upper face 122 of the latch nut 117 contacts and engages the shoulder 123 of the splined housing 101. Now, in this position, the collet 311 has been interfaced with the shoulder 320 of the collet mandrel 302. As the righthand rotation is conducted, it should be noted that the valve yoke 404, the upper valve mandrel 401 and the collet mandrel 302 have been moved upwardly longitudinally as a unit a distance equal to finite distance "C" plus finite distance "A", and all of each of finite distances "D" and "E". The valve yoke 404 now has again moved an amount equal to the finite distance "F" such that the inner face 427 of the valve yoke 404 is against the carriage pin 439, and the ball 405 has been rotated to the closed position. Since the stab-in assembly 300 still is partially threadedly interfaced along the nut 117, the ball 405 may be pressure tested to assure control of the well through the drill pipe DP before the stab-in assembly 300 is completely disengaged from the outer housing 100.

After the collect 311 is shouldered against the shoulder 320 of the collect mandrel 302, as described above, the drill pipe DP is again rotated to the right to completely disengage the threads between the spoon 315 and the nut 117. This position is as shown in FIGS. 7G and 7H. As the stab-in assembly 300 is picked up together with the drill pipe DP, the spring 143 will urge the lug sleeve 139 upwardly. Because the spring 128 will urge the lug retainer 132 downwardly, the lug 136 is shifted out of the groove 135 and into the groove 501C of the latch sleeve 501 for unitized movement, and to the position as shown in FIG. 2A. Now, the outer housing 100 of the apparatus A remains in position as illustrated in FIGS. 2A and 2B.

There may be circumstances in which the apparatus A is positioned for testing, as illustrated in FIGS. 5A and 5B, and rotational and/or torque force cannot be applied, or cannot be applied in time, to the drill pipe DP to manipulate the ball 405 to the closed position to control the well, in the event of an emergency. Therefore, the apparatus A is designed such that the ball 405 may be manipulated to the closed position by hydraulic means, while the stab-in assembly 300 still is latched within the outer housing 100. Referring now to FIGS. 6A and 6B, in an emergency, or when the testing is completed, or in order to assure that the ball 405 is in the closed position, the lower ram R-2 is sealingly engaged against the exterior of the bottom housing 106. The upper ram R-1 is sealingly secured against and around the exterior of the splined mandrel 301 above the shoulder 306. Now, weight is applied to the drill pipe DP such that the splines 115–307 become disengaged from within their respective splineways 116–308 and the lower face 318 of the splined mandrel 301 becomes shouldered upon the upper end 319 of the collet 311. Application of weight on the drill pipe DP and the stab-in assembly 300 causes the splined mandrel 301, the collet mandrel 302, the upper valve mandrel 401, the lug mandrel 403 and the valve yoke 404 to move correspondingly downwardly an amount corresponding to the finite distance "C" between the upper end 319 of the collet 311 and the lower face 318 of the splined mandrel 301. In this position, the valve yoke 404 has moved downwardly an amount equivalent to finite distance "F", but rotation of the ball 405 has not yet been initiated. Additionally, this downward travel of the stab-in assembly 300 relative to the stabilized outer housing 100 also moves the latch sleeve 501 downwardly an amount corresponding to the distance "C" by means of the shoulder 322 of the collet mandrel 301 pushing against the upper end 503A of the latch sleeve 501, to further compress the spring 502, thereby half way removing the latch sleeve 501 from the interior of the collet 311.

Thereafter, hydraulic pressure is applied through the choke or kill line and communicates to the outer housing 100 between the rams R-1 and R-2 and enters the outer housing 100 by means of the opening 182A of the hydraulic housing 104. Pressure is transmitted through the bore 182, into the high pressure chamber 520, and acts on the hydraulic piston 503 between the rings 517 and 189. As pressure is increased within the chamber 520, the hydraulic piston 503 is caused to move upwardly and away from the shoulder 191, pressure within the low pressure chamber 521A above the ring 516 being substantially lower than that contained within the high pressure chamber 520 to enable shifting of the piston 503. As stated above, the low pressure chamber 521A communicates with the passageway portion 161B', the portion 161B, 161C, 161D, and to the opening 161E to the well therebelow and below the closed ram R-2 around the bottom housing 106. As the hydraulic piston 503 moves upwardly, the groove 516 of the piston 503 is carried longitudinally and immediate the lower lug 402. As the lower lug 402 and the groove 516 become laterally interaligned, the lower lug 402 is urged out of the groove 414 and into the groove 516, whereby the lug mandrel 403 is longitudinally disengaged from the upper valve mandrel 401 and now is longitudinally shiftable together with the hydraulic piston 503, as shown in FIG. 6B.

As the hydraulic piston 503, now carrying the lug 402 within its groove 516 and the lug mandrel 403, together with the valve yoke 404, are shifted upwardly by the increased pressure within the high pressure chamber 520, the hydraulic sleeve spring 504 is compressed, enabling the hydraulic piston 503, the mandrel 403 and the yoke 404 to travel in unitized relationship until such time as the upper face 418 of the lug mandrel 403 contacts and engages the lower face 171 of the spring retainer housing 109. Upon the 171–418 interface, the valve yoke 404 has traveled longitudinally a distance sufficient for the inner face 427 to engage the carriage pin 439 to rotate the ball 405 to the closed position, which is a distance equivalent to finite distance "G".

The stab-in assembly 300 also may be disengaged from the outer housing 100 without requirement of tubular rotation when the ball 405 has been rotated to the closed position by activation of the hydraulic piston 503. As noted above, a low pressure chamber 514 is defined between the ring 166 on the spring mandrel 157 and the ring 151 on the latch sleeve stop 147, together with the seal 324A on the seal unit 324. Each of these seal areas define the low pressure chamber 514, which is in communication with the well below the apparatus A by initial communication through the opening 161E below the closed ram R-2 around the bottom housing 106. The opening 161E is, in turn, in communication with the passageway portions 161D, 161C, 161B, 161A and 161A', with the well pressure communicating finally to the low pressure chamber 514 through the port 161F within the spring mandrel 157. Since this pressure will be substantially less than the pressure contained within the high pressure chamber 520 during activation of the hydraulic piston 503, a differential pressure will exist and act across the rings 166, 151 and seal 324A, and within the low pressure chamber 514, such that the latch sleeve 501 now acts as a piston and the spring 502 is compressed and is permitted to move downwardly. The latch sleeve 501 continues to be urged downwardly until such time as the shoulder 506 on the latch sleeve 501 interfaces with the upper end 147A of the latch sleeve stop 147. In this position, the groove 504 is interaligned with the lug 136, but the lug 136 still remains partially housed within the groove 135 of the lug retainer 132, and the sleeve 139 and lug retainer 132 are unitized. In this position, the upper end 503A of the latch sleeve 501 has moved away from the interior of the fingers 314 whereby the inner lip 503 of the latch sleeve 501 no longer prevents inward contraction of the fingers 314 and the spoon 315 now is enabled to flex inwardly, thus frictionly freeing the threads 316 exteriorly located thereon from within companion threadways 124 on the floating latch nut 117. In this position, shown in FIGS. 6A and 6B, it can be seen that the stab-in assembly 300 may be easily removed from the outer housing 100 by picking up on the drill pipe DP. It is not required to rotate the drill pipe DP to unlatch the stab-in assembly 300 from the outer housing 100.

As also illustrated in FIGS. 7C and 7D, as an optional feature, the stab-in assembly 300 may be latched into the outer housing 100 without utilization of the shear pins 312. This can be accomplished when it is assured that pressure within the well and in the drill pipe DP is controlled below the apparatus A, or there is no or insignificant pressure within the well and the drill pipe DP. This feature enables the operator to both latch the stab-in assembly 300 into the outer housing 100 and manipulate the ball 405 to the open position in one procedure.

The removal of the shear pin 312 enables complete free play between the collet 311 and the collet mandrel 301, between the shoulder 320 and the upper face 318 to the extent that the stab-in assembly 300 can be moved into the outer housing 100 one-half of the length of the threads 124 and 316 between the nut 117 and the spoon 315 (equal to the finite distance "B"), as well as finite distance "C". These combined distances are sufficient to completely enable the valve yoke 404 to travel from the neutral position (finite distance "F"), as well as position the inner face 427 on the carriage pin 439 to manipulate the ball 405 to the open position. The yoke 404 thus is also enabled to travel the entire finite distances of "F" and "G".

To rotate the ball 405 to the open position without the shear pin 312 being in place within the collet 311, the stab-in assembly 300 is run on the drill pipe DP and lowered through the outer housing 100. The lower end 317 of the collet 311 will contact and engage the upper end 140 of the lug sleeve 139 until the lower end 142 of the lug sleeve 139 shoulders against the shoulder 133A of the latch housing 102. Because the lug 136 is shifted into the groove 135 of the retainer 132, the retainer 132 will travel with the sleeve 139 and will have its lower face 134 against the shoulder 133 of the latch housing 102. As the lug retainer 132 and the lug sleeve 139 are shouldered downwardly against the latch housing 102, the upper end 319 of the collet 311 will become interfaced with the lower face 318 of the splined mandrel 301. As the positions described above are reached, the inwardly flexible fingers 314 of the collet 311 will slide against the floating latch nut 117 such that the threads 316 on the spoon 315 of the fingers 314 will contact and partially engage along the nut threads 124 after the floating latch nut has moved downwardly along the splineways 119 and 121. When the lug retainer 132 and the lug sleeve 139 are shouldered on the latch housing 102, the threads 316 will be engaged approximately half way within the corresponding threads 124 of the floating latch nut 117. Accordingly, this finite distance "B", plus the free travel distance between the shoulder 320 and the lower face 318 of the splined mandrel 301 (finite distance "C"), are sufficient to completely enable the valve yoke 404 to longitudinally manipulate both to the neutral position (the finite distance "F"), and to be interfaced with the carriage pin 439 (finite distance "G"), to rotate the ball 405 to the open position such that the ball interior 405A communicates with the interior 212 below the ball valve and the interior 400A thereabove, and drill stem testing equipment and the like may be inserted completely through the apparatus A. Thereafter, the drill pipe DP is rotated to the left to place the apparatus A in the testing position.

To disengage the stab-in assembly 300 from the outer housing 100, when the shear pins 312 are removed from or are not initially placed in the collet 311, the drill pipe DP is set down and the mechanical disengaging procedure described above is utilized.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a test valve assmebly adapted to be lowered on a tubular string between upper and lower tubular sections into position within a blowout preventer stack at the upper end of a bore of a well, the improvement comprising: a housing having first and second fluid flow passages therethrough; a valve member between said flow passages and shiftable in said housing to open position to communicate said flow passages during selective incremental testing of said well and manipulatable in said housing to closed position to isolate said flow passages prior to and subsequent to selective incremental testing of said well; means responsive to mechanical manipulation of said tubular string for shifting said valve member between closed and open positions; and clutch means whereby said upper tubular section may be selectively rotationally engaged with said lower tubular section during testing of said well and when said valve member is in open position.

2. In a test valve assembly adapted to be lowered on a tubular string between upper and lower tubular sections into position within a blowout preventer stack at the upper end of a bore of a well, the improvement comprising: a housing having first and second fluid flow passages therethrough; a valve member between said flow passages and shiftable in said housing to open position to communicate said flow passages during selective incremental testing of said well and manipulatable in said housing to closed position to isolate said flow passages prior to and subsequent to selective incremental testing of said well; and means responsive to mechanical manipulation of said tubular string for selective latching engagement of said valve assembly with said upper tubular section and for shifting said valve member between closed and open positions.

3. The apparatus of claim 2 wherein said means responsive to mechanical manipulation of said tubular string is moveable in a first direction to a first position to latch said valve assembly with said upper tubular section.

4. The apparatus of claim 2 wherein said means responsive to mechanical manipulation of said tubular string is moveable in a first direction to a first position to latch said valve assembly with said upper tubular section without manipulating said valve member between closed and open positions.

5. The apparatus of claim 2 wherein said means responsive to mechanical manipulation of said tubular string is moveable in a first longitudinal direction to a first position to latch said valve assembly with said upper tubular section.

6. The apparatus of claim 2 wherein said means responsive to mechanical manipulation of said tubular string is moveable in a first longitudinal direction to a first position to latch said valve assembly with said upper tubular section without manipulating said valve member between closed and open positions.

7. The apparatus of claim 2 wherein said means responsive to mechanical manipulation of said tubular string is moveable in a first direction to a first position to latch said valve assembly with said upper tubular section without manipulating said valve member between closed and open positions, and is manipulatable in at least a second direction and other than in said first direction to a second position to manipulate said valve member between closed and open positions.

8. The apparatus of claim 2 wherein said means responsive to mechanical manipulation of said tubular string is moveable in a first longitudinal direction to a first position to latch said valve assembly with said upper tubular section and is manipulatable in at least a second direction other than in said first direction to a second position to manipulate said valve member between closed and open positions.

9. The apparatus of claim 2 wherein said means responsive to mechanical manipulation of said tubular string is moveable in a first longitudinal direction to a first position to latch said valve assembly with said upper tubular section and is manipulatable in at least one of longitudinal and rotational directions to a second position to manipulate said valve member between closed and open positions.

10. The apparatus of claim 2 wherein said means responsive to mechanical manipulation of said tubular string is moveable in a first longitudinal direction to a first position to latch said valve assembly with said upper tubular section without manipulating said valve member between closed and open positions and is manipulatable in at least one of longitudinal and rotational directions to a second position to manipulate said valve member between closed and open positions.

11. The apparatus of claims 1 or 2 wherein said means responsive to mechanical manipulation comprises: a stab-in assembly; flexible collet means carried on one of said housing and said stab-in assembly; and collet engaging means selectively interengageable with said flexible collet means and carried on the other of said housing and said stab-in assmebly.

12. The apparatus of claims 1 or 2 wherein said means responsive to mechanical manipulation comprises: a stab-in assembly; flexible collet means carried on one of said housing and said stab-in assembly; collet engaging means selectively interengageable with said flexible collet means and carried on the other of said housing and said stab-in assembly; and valve yoke means manipulatably engageable with said valve member and responsive to mechanical manipulation of said tubular string to shift said valve member between each of closed and open positions, said collet means and said collet engaging means being interengageable a first finite distance whereby said yoke means does not manipulate said valve member from one of closed and open positions to the other of closed and open positions.

13. The apparatus of claims 1 or 2 wherein said means responsive to mechanical manipulation comprises: a stab-in assembly; flexible collet means carried on one of said housing and said stab-in assembly; collet engaging means selectively interengageable with said flexible collet means and carried on the other of said housing and said stab-in assembly; and valve yoke means manipulatably engageable with said valve member and responsive to mechanical manipulation of said tubular string to shift said valve member between each of closed and open positions, said collet means and said collet engaging means being interengageable a first finite distance whereby said yoke does not manipulate said valve member from one of closed and open positions to the other of closed and open positions, said collet means and said collet engaging means being interengageable a second finite distance whereby said yoke means manipulates said valve member to one of closed and open positions from the other of closed and open positions.

14. In a test valve assembly adapted to be lowered on a tubular string between upper and lower tubular sections into position within a blowout preventer stack at the upper end of a bore of a well, said well having a flow conduit therethrough for transmission of fluid to isolate and kill said well, the improvement comprising: a housing having first and second fluid flow passages therethrough; a valve member between said flow passages and shiftable in said housing to open position to communicate said flow passages during selective incremental testing of said well and manipulatable in said housing to closed positions to isolate said flow passages prior to and subsequent to selective incremental testing of said well; means responsive to mechanical manipulation of said tubular string for selective latching engagement of said valve assembly with said upper tubular section and for shifting said valve member between closed and open positions; and auxiliary unlatching and valve member closing means comprising longitudinally shiftable piston means responsive to pressure transmitted through said flow conduit to manipulate said valve member from open to closed position and for unlatching of said valve assembly from said tubular string.

15. The apparatus of claim 14 wherein said means responsive to mechanical manipulation of said tubular string is moveable in a first direction to a first position to latch said valve assembly with said upper tubular section.

16. The apparatus of claim 14 wherein said means responsive to mechanical manipulation of said tubular string is moveable in a first direction to a first position to latch said valve assembly with said upper tubular section without manipulating said valve member between closed and open positions.

17. The apparatus of claim 14 wherein said means responsive to mechanical manipulation of said tubular string is moveable in a first longitudinal direction to a first position to latch said valve assembly with said upper tubular section.

18. The apparatus of claim 14 wherein said means responsive to mechanical manipulation of said tubular string is moveable in a first longitudinal direction to a first position to latch said valve assembly with said upper tubular section without manipulating said valve member between closed and open positions.

19. The apparatus of claim 14 wherein said means responsive to mechanical manipulation of said tubular string is moveable in a first longitudinal direction to a first position to latch said valve assembly with said upper tubular section without manipulating said valve member between closed and open positions and is manipulatable in at least a second direction to a second position to manipulate said valve member between closed and open positions.

20. The apparatus of claim 14 wherein said means responsive to mechanical manipulation of said tubular string is moveable in a first longitudinal direction to a first position to latch said valve assembly with said upper tubular section and is manipulatable in at least one of longitudinal and rotational directions to a second position to manipulate said valve member between closed and open positions.

21. The apparatus of claims 1 or 2 wherein said means responsive to mechanical manipulation comprises: a stab-in assembly; flexible collet means carried on one of said housing and said stab-in assembly; collet engaging means selectively interengageable with said flexible collet means and carried on the other of said housing and said stab-in assembly; and valve yoke means manipulatably engageable with said valve member and responsive to mechanical manipulation of said tubular string to shift said valve member, said collet means and said collet engaging means being interengageable a first finite distance whereby said yoke does not manipulate said valve member from one of closed and open positions to the other of said closed and open positions, said collet means and said collet engaging means being longitudinally moveable as a unit a second finite distance such that said yoke means manipulates said valve member to one of closed and open positions from the other of closed and open positions, said stab-in assembly being thereafter manipulatable in at least one of longitudinal and rotational directions, whereby the stab-in assembly and the housing may be completely interlatched.

22. In a test valve assembly adapted to be lowered on a tubular string between upper and lower tubular sections into position within a blowout preventer stack at the upper end of a bore of a well, the improvement comprising: a housing having first and second fluid flow passages therethrough; a valve member between said flow passages and shiftable in said housing to open position to communicate said flow passages during selective incremental testing of said well and manipulatable in said housing to closed position to isolate said flow passages prior to and subsequent to selective incremental testing of said well; means responsive to each of longitudinal and rotational manipulation of said tubular string for shifting said valve member between closed and open positions; and clutch means whereby said upper tubular section may be selectively rotationally engaged with said lower tubular section during testing of said well and when said valve member is in open position.

23. The apparatus of claims 1 or 2 wherein said means responsive to mechanical manipulation comprises: a stab-in assembly; flexible collet means carried on one of said housing and said stab-in assembly; collet engaging means selectively interengageable with said flexible collet means and carried on the other of said housing and said stab-in assembly; and valve yoke means manipulatably engageable with said valve member and responsive to mechanical manipulation of said tubular string to shift said valve member between each of closed and open positions, said collet means and said collet engaging means being interengageable a first finite distance in response to mechanical manipulation of said tubular string in a first direction whereby said yoke does not manipulate said valve member from one of closed and open positions to the other of closed and open positions, said collet means and said collet engaging means being interengageable a second finite distance in response to mechanical manipulation of said tubular string in at least a second direction and said yoke means manipulates said valve member to one of closed and open positions from the other of closed and open positions.

24. In a test valve assembly adapted to be lowered on a tubular string between upper and lower tubular sections into position within a blowout preventer stack at the upper end of a bore of a well, said well having a flow conduit therethrough for transmission of fluid to isolate and kill said well, the improvement comprising: a housing having first and second fluid flow passages therethrough; a valve member between said flow passages and shiftable in said housing to open position to communicate said flow passages during selective incremental testing of said well and manipulatable in said housing to closed position to isolate said flow passages prior to and subsequent to selective incremental testing of said well; means responsive to mechanical manipulation of said tubular string for selective latching engagement of said valve assembly with said upper tubular section and for shifting said valve member between closed and open positions; and auxiliary unlatching and valve member closing means comprising longitudinally shiftable piston means responsive to pressure transmitted through said flow conduit to manipulate said valve member from open to closed position and for unlatching of said valve assembly from said tubular string, said auxiliary unlatching and valve member closing means further comprising lug means selectively carriable by said piston means for auxiliary shifting of said means responsive to mechanical manipulation of said tubular string to shift said valve member from open to closed position.

25. A method of operating a test valve assembly adapted to be lowered on a tubular string between upper and lower tubular sections into position within a blowout preventer at the upper end of a bore of a well for selective control of flow of fluid through said tubular string and said test valve assembly prior and subsequent to the testing of said well, comprising the steps of: (a) lowering within said blowout preventer stack and on said tubular string a housing having first and second fluid flow passages therethrough, a valve member between said flow passages and shiftable in said housing to open position to communicate said flow passages during selective incremental testing of said well and manipulatable in said housing to closed position to isolate said flow passages prior to and subsequent to selective incremental testing of said well, means responsive to mechanical manipulation of said tubular string for shifting said valve member between closed and open positions, and clutch means whereby said upper tubular section may be selectively rotationally engaged with said lower tubular section during testing of said well and when said valve member is in open position; (b) and manipulating said tubular string, selectively, in each of longitudinal and rotational directions to manipulate said valve member between open and closed positions to selectively control flow of fluid through said flow passages and to selectively activate said clutch means.

26. A method of manipulating a test valve assembly adapted to be lowered on a tubular string between upper and lower tubular sections into position within a blowout preventer stack at the upper end of a bore of a well, said test valve assembly comprising a housing having first and second fluid flow passages therethrough, a valve member between said flow passages and shiftable in said housing to open position to communicate said flow passages during selective incremental testing of said well and manipulatable in said housing to closed position to isolate said flow passages prior to and subsequent to selective incremental testing of said well, clutch means whereby said upper tubular section may be selectively rotationally engaged with said lower tubular section during testing of said well and when said valve member is in open position, and means responsive to mechanical manipulation of said tubular string for shifting said valve member between closed and open positions, said means responsive to mechanical manipulation comprising: a stab-in assembly; flexible collet means carried on one of said housing and said stab-in assembly; collet engaging means selectively interengageable with said flexible collet means and carried on the other of said housing and said stab-in assembly; and valve yoke means manipulatably engageable with said valve member and responsive to mechanical manipulation of said tubular string to shift said valve member, said method comprising the steps of: (a) manipulating said tubular string in at least a first direction whereby said collet means and said collet engaging means are interengageable a first finite distance and said yoke does not manipulate said valve member from one of closed and open positions to the other of closed and open positions; (b) shifting said tubular string whereby said collet means and said collet engaging means are longitudinally moveable as a unit a second finite distance whereby said yoke means manipulates said valve member to one of closed and open positions; and (c) manipulating said tubular string in at least one longitudinal and rotational directions to completely interlatch said stab-in assembly and said housing.

* * * * *